US007789489B2

(12) United States Patent
Matsuzoe

(10) Patent No.: US 7,789,489 B2
(45) Date of Patent: Sep. 7, 2010

(54) PRINT HEAD AND IMAGE FORMING APPARATUS INCLUDING THE SAME

(75) Inventor: Hisanobu Matsuzoe, Fukuoka (JP)

(73) Assignees: Fukuoka Technoken Kogyo, Co., Ltd., Fukuoka (JP); Kobayashi Create Co., Ltd., Aichi-ken (JP)

( * ) Notice: Subject to any disclaimer, the term of this patent is extended or adjusted under 35 U.S.C. 154(b) by 959 days.

(21) Appl. No.: 10/582,105

(22) PCT Filed: Mar. 11, 2005

(86) PCT No.: PCT/JP2005/004280

§ 371 (c)(1),
(2), (4) Date: Jun. 8, 2006

(87) PCT Pub. No.: WO2005/087496

PCT Pub. Date: Sep. 22, 2005

(65) Prior Publication Data

US 2007/0176973 A1 Aug. 2, 2007

(30) Foreign Application Priority Data

Mar. 11, 2004 (JP) ..... 2004-069350

(51) Int. Cl.
*B41J 2/06* (2006.01)
*B41J 2/05* (2006.01)

(52) U.S. Cl. ..... 347/55; 347/56

(58) Field of Classification Search ..... 347/55, 347/68, 70–72, 56
See application file for complete search history.

(56) References Cited

FOREIGN PATENT DOCUMENTS

JP H08-72292 3/1996
JP 2003-326756 11/2003

*Primary Examiner*—An H Do
(74) *Attorney, Agent, or Firm*—Jean C. Edwards, Esq.; Akerman Senterfitt

(57) ABSTRACT

It is an object of the present invention to provide a print head that is usable in a horizontal printer, that is small in size, that is superior in mass production, that can easily perform discharge control, that is excellent in reliability, and that is excellent in practicality to be writable in a state in which a recording medium is not bent. The print head has a discharge control unit. The discharge control unit includes a heating mechanism and a discharge portion. The heating mechanism includes a heat generation portion provided with a heat generation body and a driver IC that controls heat generation of the heat generation body. The discharge portion includes a discharge electrode disposed in accordance with the heat generation body. In the discharge control unit, the heat generation portion and the discharge portion are insulated from each other.

10 Claims, 11 Drawing Sheets

PRINT HEAD AND IMAGE FORMING APPARATUS INCLUDING THE SAME

CROSS-REFERENCE TO RELATED APPLICATIONS

The present application is a 35 U.S.C 371 national stage entry of International Patent Application No. PCT/JP2005/004280, filed Mar. 11, 2005, which claims priority from Japanese Patent Application No. JP 2004-069350, filed Mar. 11, 2004, the contents of which are herein incorporated by reference in their entirety.

BACKGROUND OF THE INVENTION

1. Field of the Invention

The present invention relates to a print head that can form an image by ion projection or light emission caused by an electric discharge, and relates to an image forming apparatus including the print head.

2. Description of the Related Art

In recent years, an ion projection method that is an electrostatic latent image forming method different from an electrophotographic method has been developed (see Japanese Published Unexamined Patent Application No. 2003-326756, mentioned below, for example).

According to the electrophotographic method, an electrostatic latent image is formed on a photoconductor serving as an electrostatic latent image carrier by expelling an electric charge of an exposed part on the uniformly electrified photoconductor through two steps consisting of a uniform charging step and an exposure step. On the other hand, according to the ion projection method, in an atmosphere (for example, in atmospheric air) in which ions can be generated, the formation of an electrostatic latent image on an electrostatic latent image carrier (which is not necessarily required to be a photoconductor, because what is required of the carrier is to be an insulator) can be completed by selective electrification (electrostatic-latent-image forming electrification) by ion projection caused by an electric discharge from a discharge electrode. Therefore, the ion projection method is an electrostatic latent image forming method that has been made simpler and that does not need to use an exposure optical system such as a polygon mirror.

An image forming apparatus employing the electrostatic latent image forming method using the ion projection method can directly form an electrostatic latent image by ion projection on a recording medium of an electrostatic development type which is typified by digital paper and in which a visible image appears while reacting to the electric charge of an electrostatic latent image formed on its surface. Therefore, under the circumstances, this apparatus is the best conceivable image forming apparatus, in order to write data onto the electrostatic development type recording medium in a non-contact manner (see FIG. 4 of Japanese Published Unexamined Patent Application No. JP 2003-326756).

At present, digital paper can be achieved according to the following methods, i.e., a twist ball method in which extremely small balls are classified into two colors (for example, black and white), and an arbitrary color is displayed by rotating the balls according to a difference in electric characteristics of each color; an electrophoretic method in which impalpable powder with two colors (for example, black and white) is mixed with extremely small balls, and only one color is surfaced and displayed by a difference in electric characteristics of impalpable powder of each color; and a liquid crystal method in which a liquid crystal shutter of a liquid crystal plate or an extremely small liquid crystal block is opened or closed, and a background color of a part appearing by opening the shutter is displayed.

However, Japanese Published Unexamined Patent Application No. 2003-326756 merely discloses a basic concept of a digital-paper-acceptable apparatus that includes an ion generating device or a regular-paper-acceptable apparatus that employs an electrostatic latent image forming method having no optical system. In other words, Japanese Published Unexamined Patent Application No. 2003-326756 disclosing the image forming apparatus gives no description of, for example, a detailed structure of a print head. Especially, a study has been expected to be made of the concrete specifications of a print head suitable to record data on a thick recording medium such as digital paper.

A rewritable recording medium, such as digital paper, is assumed to be repeatedly used about several thousand times. To satisfy this severe durability, a conventional problem resides in the fact that there is a need to develop a horizontal-printer-usable print head that can perform a writing operation in a state in which the recording medium is not bent in order for the recording medium not to cause a distortion as much as possible when used.

Another conventional problem resides in the fact that there is a need to develop a print head corresponding to shapes of various electrostatic latent image carriers (ion projected body), such as a drum type carrier or a belt type carrier, when an electrostatic latent image is written onto the electrostatic latent image carrier in a regular-paper-acceptable apparatus that employs an electrostatic latent image forming method.

SUMMARY OF THE INVENTION

The present invention has been made to solve the conventional problems mentioned above. It is therefore an object of the present invention to provide a print head that is usable in a horizontal printer, that is small in size, that is superior in mass production, that can easily perform discharge control, that is excellent in reliability, and that is excellent in practicality to be writable in a state in which a recording medium is not bent, and provide an image forming apparatus including the print head that is superior in the arrangement flexibility of the print head with respect to an electrostatic latent image carrier, that is superior in the general versatility of being capable of forming an electrostatic latent image from an optimum position on the electrostatic latent image carrier that can be variously shaped, and that is superior in the reliability of image quality.

To solve the problems mentioned above, the print head of the present invention and the image forming apparatus including the print head have the following structures.

The print head as set forth in a first aspect of the present invention has a discharge-by-heating type discharge control unit. The discharge control unit includes a heating means including a heat generation portion provided with a heat generation body and a driver IC that controls heat generation of the heat generation body and a discharge portion including a discharge electrode disposed in accordance with the heat generation body, in which the heat generation portion and the discharge portion are insulated from each other. A surface on which the discharge electrode is disposed and a surface on which the driver IC is disposed are not flush with each other.

With this structure, the following effects are achieved.

(1) Since the heating means includes the heat generation portion provided with the heat generation body and the driver IC that controls the heat generation of the heat generation body, the discharge electrode corresponding to the heated heat generation body by controlling the heat generation of the heat generation body can be heated.

(2) The discharge electrode, onto which a discharge control voltage (which denotes a voltage range in which an electric discharge is caused by heating although an electric discharge is not caused merely by applying a voltage) has been applied, is thermally controlled by the heat generation body, whereby thermions are emitted from the heated discharge electrode, and an electric discharge or light emission is caused, and, in an ion-generative atmosphere, ions are projected.

(3) The discharge time of the discharge electrode can be controlled by controlling the heat time of the discharge electrode heated by the heat generation body with the heating means, and the amount of ions to be generated or the amount of light to be emitted resulting from an electric discharge can be controlled.

(4) Since the ion-generation amount can be controlled merely by controlling the heat time by the discharge control unit, the area gradation on the ion-projected body onto which ions are projected can easily be carried out, and image quality can be improved.

(5) Since the surface on which the discharge electrode is disposed and the surface on which the driver IC is disposed are not flush with each other, the surface on which the discharge electrode is disposed can be released from the yoke of the driver IC of making the arrangement surface of the discharge electrode flush with the arrangement surface of the driver IC. Therefore, the degree of freedom to arrange the discharge electrode can be increased with respect to the recording medium or the electrostatic latent image carrier that can be variously shaped, and general versatility can be improved.

In the discharge portion, an end part of the plurality of discharge electrodes divided like comb teeth facing the heat generation body can be connected with a common electrode, or both ends of the plurality of discharge electrodes can be connected with a common electrode so as to have a ladder-like shape. Since the common electrode is provided near the discharge electrode, the heat-dissipating area of the discharge electrode is enlarged, and a heat capacity is increased, and hence the cooling effect of the discharge electrode and the responsibility to the stop of heating are improved. Additionally, since a decrease in the resistance value makes it possible to always apply a stable voltage, the electric discharge can be performed further stably.

If the discharge electrode is shaped like comb teeth, the discharge electrode can be formed to have a substantially rectangular shape, a substantially trapezoidal shape, a substantially semicircular shape, or a shape obtained by a combination of these shapes. Additionally, the peripheral length near the edge of the discharge electrode can be increased by dividing a part of the discharge electrode by use of, for example, a slit or by forming a concavo-convex part on the periphery thereof. Additionally, since the discharge electrode can make a greater amount of discharge from an area near its edge, the amount of electric discharge from the discharge electrode can be increased by increasing the peripheral length near the edge, and the amount of ions to be projected or the amount of light to be emitted can be increased. Therefore, the discharge control unit can achieve excellent energy saving and excellent efficiency. Additionally, since the voltage to be applied onto the discharge electrode can be set small, the discharge electrode can achieve excellent longevity.

Instead of dividing the end of the discharge electrode or forming the concavo-convex part on the periphery, a discharge hole may be formed in accordance with the heating position of the heat generation body. If so, an electric discharge can be generated from near the edge of the discharge hole, and the same effect as that obtained by dividing the end of the discharge electrode can be obtained. The discharge hole can be formed to have various shapes, such as a substantially circular shape, a substantially elliptical shape, a polygon such as a quadrangle or a hexagon, and a star shape. The number of the discharge holes and the size thereof per place to be heated can be appropriately selected and combined.

Preferably, a metal, such as gold, silver, copper, or aluminum, is used as the material of the discharge electrode in such a way that the metal is first formed by vapor deposition, sputtering, or printing, and is then etched to form a pattern. Instead, another conductive material, such as carbon, may be used.

Since the discharge generation can be controlled by applying a discharge control voltage to the discharge electrode and heating this, the electric discharge can be selectively generated from an arbitrary discharge electrode with ease by selecting a part to be heated by the heat generation body.

Preferably, the thickness of the discharge electrode is 0.1 μm to 100 μm if the discharge electrode is made of aluminum. The discharge electrode is liable to be easily affected by wear in proportion to a decrease in thickness of the discharge electrode from 0.1 μm, whereas the discharge electrode is liable to become great in heat capacity and become small in the responsibility to ON/OFF of heating in proportion to an increase in thickness of the discharge electrode from 100 μm. Therefore, the discharge electrode having a thickness smaller than 0.1 μm and greater than 100 μm are undesirable.

The heating means is recommended to be capable of heating an arbitrary part of the single heat generation body disposed extending over the plurality of discharge electrodes or be capable of selectively heating the plurality of heat generation bodies each of which is individually disposed in accordance with the plurality of discharge electrodes. Since the heat generation body is electrically connected with the electrode formed to be a comb-teeth-like pattern or a matrix-like pattern, a part of the single heat generation body corresponding to an arbitrary discharge electrode can be energized and heated, or an arbitrary one of the plurality of heat generation bodies corresponding to each discharge electrode can be selectively energized and heated. Preferably, the heating means is structured in the same way as in a thermal print head used in a conventional thermal type facsimile apparatus.

Preferably, $TaSiO_2$ or $RuO_2$ is used as the heat generation body.

A heat generation portion insulating film is formed to protect and insulate the heat generation body and the electrode connected to the heat generation body. It is desirable to use a high-heat-conductive material capable of efficiently transmitting the heat of the heat generation body to the discharge electrode as the material of the heat generation portion insulating film. Preferably, SiAl, $SiO_2$, SiC, lead glass, or mica is used. The heat generation portion insulating film is formed according to screen printing, vapor deposition, or sputtering.

The thickness of the heat generation portion insulating film is preferably 2 μm to 50 μm, and more preferably 4 μm to 40 μm if the heat generation portion insulating film is made of glass. Insulation properties are liable to be easily lowered in proportion to a decrease in thickness of the heat generation portion insulating film from 4 μm, whereas there is a need to increase the voltage to be applied to the discharge electrode or increase the amount of heat to be generated by the heat generation body, and energy saving is liable to be easily lowered in proportion to an increase in thickness of the heat generation portion insulating film from 40 μm. Additionally, the dispersion of heat is liable to occur, and the resolution degree is liable to be lowered. The surface of the heat generation body and the surface of the electrode connected to the heat generation body cannot be reliably covered therewith especially in proportion to a decrease in thickness of the heat generation portion insulating film from 2 μm. Therefore, unreliably, pinholes easily occur. On the other hand, the stability of an electric discharge is easily lowered in proportion to an increase in thickness thereof from 50 μm, and excellent mass productivity cannot be achieved. The thickness of the heat generation portion insulating film smaller than 2 μm and greater than 50 μm are undesirable. Insulation properties and thermal conductivity can be excellently harmonized with each other, and excellent stability of an electric discharge can be achieved by setting the thickness of the heat generation portion insulating film at 2 μm to 50 μm, preferably 4 μm to 40 μm. The possibility that pinholes will be overlapped with each other can be decreased especially by forming the heat generation portion insulating film by recoating performed plural times even if pinholes are generated by coating performed every one time. Therefore, the heat generation portion can be reliably insulated, and excellent reliability can be achieved.

When the plurality of discharge electrodes and the heat generation bodies are disposed in a zigzag, n-row discharge electrodes and n-row heat generation bodies formed with the same basic pitch are disposed in a state in which each is staggered by 1/n of the basic pitch. As a result, the minimum pitch can be set at 1/n of the basic pitch, and the resolution degree of the whole can be improved. Since the plurality of discharge electrodes and heat generation bodies can be formed with the same basic pitch, machining can easily be performed, and the yield can be improved under excellent mass productivity.

When the discharge electrodes are disposed in a zigzag, the plurality of discharge electrodes connected with a single common electrode can be arranged side by side while setting a plurality of rows thereof as one-row unit. A one-row discharge electrode and a one-row discharge electrode may be formed with a single common electrode therebetween in the manner in which the pitch is staggered. The plurality of rows of common electrodes disposed side by side may be independent of each other, or the ends of the common electrodes may be connected together so as to be shaped like the letter "C" or like comb teeth.

Additionally, since the pitch in the direction in which the discharge electrodes and the heat generation bodies whose images have been thrown onto the horizontal surface are arranged can be made smaller than the basic pitch by inclining and disposing the whole of the rows of discharge electrodes and heat generation bodies formed with the basic pitch, these components can be highly densely mounted without limitations on machining.

If an induction electrode that is disposed apart from the discharge electrode and that is insulated from the discharge electrode is provided, a gap between the discharge electrode and the induction electrode is always kept constant. Therefore, an electric discharge can be reliably generated by applying a voltage between the discharge electrode and the induction electrode.

If the induction electrode is offset in the horizontal direction from the end (edge) on the side of the heat generation body of the discharge electrode and is formed on the heat generation portion insulating film, the induction electrode can be reliably insulated by covering the induction electrode with an induction electrode insulating film, and hence the occurrence of a short circuit can be prevented.

If the induction electrode is provided, the discharge electrode may be formed on the heat generation portion insulating film or may be formed on the induction electrode insulating film formed on the induction electrode.

Additionally, the induction electrode can be formed on the upper part of the discharge electrode with the induction electrode insulating film therebetween.

As in the heat generation portion insulating film, glass, ceramic, mica, or synthetic resin can be suitably used as the material of the induction electrode insulating film. The film thickness thereof and the forming method thereof are also the same as in the heat generation portion insulating film.

Ions can be projected from the discharge electrode of the print head onto the recording medium by grounding the side of the recording medium onto which recording is performed by the print head regardless of the presence or absence of the induction electrode. If negative ions are projected, the same effect can be achieved by applying a positive voltage to the side of the recording medium. Therefore, the unit dot of the image forming apparatus can be made fine, and accuracy in the projected position can be improved, and hence high-definition recording can be performed. For example, a step of forming the induction electrode can be omitted if the induction electrode is not provided. Therefore, excellent productivity can be achieved, and the discharge control unit can be reduced in size to be highly densely mounted, and hence the print head can achieve high resolution.

Although a part of the discharge portion near the position heated by the heat generation body serves as the discharge generating portion, it is preferable to form a coating film on the discharge portion excluding the discharge generating portion. If the discharge portion includes a common electrode and a discharge electrode, the coating film is formed on the discharge electrode excluding the common electrode and the discharge generating portion. A step (i.e., a difference in level) can be formed between the surface of the discharge generating portion and the surface of the coating film by forming the coating film excluding the discharge generating portion of the discharge electrode. Therefore, since a gap between the discharge electrode and the recording medium, or the like, that faces the discharge electrode can be kept constant, an electric discharge can be stably performed from the discharge electrode. Additionally, the recording medium can be prevented from coming into contact with the discharge generating portion of the discharge electrode.

In more detail, the coating film has an opening formed substantially in the shape of a circle, an ellipse, or a rectangle at the discharge generating portion of the discharge portion (near the position of the heat generation body). The opening may be formed independently with respect to each of the discharge generating portions, or may be formed in the shape of a long hole extending over a plurality of the discharge generating portions.

The coating film is made of the same insulator as the heat generation portion insulating film and the induction electrode insulating film mentioned above. Preferably, glass, synthetic resin such as aramid or polyimide, ceramic such as $SiO_2$, or mica is used as the material of the coating film. The coating film can be formed according to screen printing, vapor deposition, or sputtering.

If a concavo-convex part is formed on the surface of the coating film, the surface distance of the coating film can be lengthened, and the surface resistance can be increased. Therefore, electric leakage can be prevented from being caused from the discharge generating portion of the discharge electrode, and the stability of discharge control can be improved without the adverse influence of the heating means upon the driver IC. Additionally, since electric leakage never occurs, a voltage applied onto the discharge electrode is never lowered, and hence excellent stability and efficiency of the electric discharge can be achieved.

The head substrate is formed by forming the discharge portion and the heat generation portion on a hard substrate made of, for example, ceramic. The discharge control unit is formed by electrically connecting the driver IC that controls heat generation to the heat generation portion of the head substrate. The driver IC is subjected to wire bonding to a lead pattern extending from the heat generation portion with a gold wire, and the connection part is sealed with IC-protecting resin such as epoxy resin. The print head is formed by disposing a printed circuit board provided with a connector to be electrically connected to the outside, together with the discharge control unit, on a heat radiating plate made of, for example, aluminum. Since heat generated by the heat generation portion is promptly absorbed by the heat radiating plate and is dissipated from the heat radiating plate, the heat generation portion can be quickly cooled. Therefore, the responsibility to the stop of an electric discharge corresponding to the stop of heating can be improved. Additionally, the driver IC and other elements can be protected from heat, and excellent reliability can be achieved. If a rugged part is formed by, for example, grooves on the surface of the heat radiating plate, the surface area of the heat radiating plate can be increased, and the efficiency of heat radiation can be improved.

An IC cover to protect the driver IC may be formed on the surface of the driver IC. If so, the contact between the driver IC and the recording medium or the like can be reliably prevented, and excellent reliability can be achieved.

The surface on which the discharge electrode is disposed is required to have a positional relationship in which the driver IC does not interfere with the electrostatic latent image carrier or the recording medium when the discharge electrode is caused to face the electrostatic latent image carrier or the recording medium on a plane differing from the surface on which the driver IC is disposed. In more detail, preferably, in the print head, the discharge electrode is disposed on an end surface part of the substrate substantially perpendicular to the surface of the substrate on which the driver IC is disposed, a substantially barrel-roof-shaped ridge jutting from the surface of the substrate, or an edge of the substrate making a substantially obtuse angle with the surface of the substrate. The driver IC may be disposed on a step part or an inclined part of the substrate formed so as to be lower than the surface on which the discharge electrode is disposed on the side of the surface of the substrate. Alternatively, the discharge electrode may be disposed on the surface side of the substrate, whereas the driver IC may be disposed on the end surface of the substrate or the reverse side of the substrate.

The invention as set forth in a second aspect is the print head as set forth in the first aspect, in which a way according to which the discharge electrode is arranged is an end-surface type in which the discharge electrode is disposed at an end surface part of a substrate on which the driver IC is disposed.

With this structure, the following effects are achieved in addition to the effects of the first aspect.

(1) Since the discharge electrode is disposed at the end surface part of the substrate on which the driver IC is disposed, and since the driver IC and the discharge electrode are disposed to be substantially perpendicular to each other, especially a recording medium, such as digital paper, which should not be bent, can be conveyed rectilinearly, and hence the print head can be suitably used in a horizontal printer.

(2) Since the way according to which the discharge electrode is arranged is the end surface type, the width of a part facing the electrostatic latent image carrier or the recording medium can be made small, and hence the print head can be disposed without being bulky in the horizontal direction. Especially, the print head can correspond to electrostatic latent image carriers having various shapes, and excellent general versatility can be achieved.

If the way according to which the discharge electrode is arranged is the end-surface type, at least the discharge electrode of the discharge portion is disposed at the end surface part of the substrate, and the driver IC is disposed on the surface of the substrate. At this time, it is preferable to form the end surface part of the substrate substantially in the shape of a circular arc. If so, the discharge electrode, the heat generation portion insulating film, and a lead pattern by which the heat generation portion and the driver IC are connected, which are disposed between the end surface part of the substrate and the surface thereof, can be formed on a gently curved surface, and the occurrence of cracks or disconnection can be prevented, and hence excellent reliability can be achieved. The end-surface type includes a way in which the substrate is formed substantially in the shape of the letter "L" or the letter "<," for example, by bending the end surface part of the substrate toward the surface of the substrate.

The invention as set forth in a third aspect is the print head as set forth in the first aspect, in which a way according to which the discharge electrode is arranged is an edge type in which the discharge electrode is disposed on an edge of a substrate on which the driver IC is disposed, so as to make an obtuse angle with a surface of the substrate.

With this structure, the following effects are achieved in addition to the effects of the first aspect.

(1) Since the discharge electrode is disposed at the end edge of the substrate on which the driver IC is disposed, and since the driver IC and the discharge electrode are disposed so as to make an obtuse angle therebetween, especially a recording medium, such as digital paper, which should not be bent, can be conveyed rectilinearly, and hence the print head can be suitably used in a horizontal printer.

(2) Since the way according to which the discharge electrode is arranged is the edge type, the print head can be disposed without being bulky in the height direction, and can correspond to electrostatic latent image carriers having various shapes, and hence excellent general versatility can be achieved.

If the way according to which the discharge electrode is arranged is the edge type, at least the discharge electrode of the discharge portion is disposed on the edge of the substrate that has been chamfered in an inclined manner, and the driver IC is disposed on the surface of the substrate. The same effect as in the end-surface type can be obtained by disposing the driver IC and the discharge electrode so as to make an obtuse angle therebetween.

The invention as set forth in a fourth aspect is the print head as set forth in the first aspect, in which a way according to which the discharge electrode is arranged is a ridge type in which the discharge electrode is disposed on a raised surface of a ridge formed on a surface of a substrate on which the driver IC is disposed.

With this structure, the following effects can be achieved in addition to the effects of the first aspect.

(1) Since the discharge electrode is disposed on the raised surface of the ridge formed on the surface of the substrate on which the driver IC is disposed, especially a recording medium, such as digital paper, which should not be bent, can be conveyed rectilinearly, and hence the print head can be suitably used in a horizontal printer.

(2) Since the way according to which the discharge electrode is arranged is the ridge type, the print head can be disposed without being bulky in the height direction, and can correspond to electrostatic latent image carriers having various shapes, and hence excellent general versatility can be achieved.

Herein, the ridge type can be regarded as having a structure in which the end surface part of the substrate on which the discharge electrode is formed is bent toward the surface of the substrate, and hence can be considered as a form of the end-surface type. In the field of the thermal print head, the ridge type is called a new end-surface type.

Although the discharge electrode can be disposed on the raised surface of the ridge, the discharge electrode is required not to interfere with the electrostatic latent image carrier and the conveying path of the recording medium.

When the discharge electrode is disposed near the apex of the ridge, the substrate can become substantially parallel to the electrostatic latent image carrier and the recording medium by allowing the apex of the ridge to jut from the upper surface of the driver IC upwardly. Additionally, when the discharge electrode is disposed on the raised surface on the opposite side of the driver IC of the ridge, the interference of the driver IC with the electrostatic latent image carrier and the recording medium can be prevented by inclining the print head so that the discharge electrode becomes substantially parallel to the electrostatic latent image carrier and the recording medium.

The invention as set forth in a fifth aspect is the print head as set forth in any one of the first to fourth aspects including a high-pressure board that is electrically connected to the discharge portion and that supplies a discharge control voltage to the discharge electrode.

With this structure, the following effects can be achieved in addition to the effects of any one of the first to fourth aspects.

(1) Since the high-pressure board electrically connected to the discharge portion is provided, an electric wire used to apply a discharge control voltage can be shortened, and reliability can be improved.

(2) Since the high-pressure board can be treated together with the print head, and since there is no need to lay electric wires, the print head can easily be incorporated into the image forming apparatus, and mass productivity can be achieved.

Herein, the high-pressure board can be disposed on, for example, the backface of the IC cover. A discharge control voltage can be supplied from the high-pressure board to the discharge electrode by being connected to the common electrode of the discharge portion. Especially in the image forming apparatus that forms an image by moving the print head for scanning, the high-pressure board can be moved together with the print head, and hence a load can be hardly imposed on electric wires, and the occurrences of defects in electric conductivity can be reduced.

The print head as set forth in the sixth aspect has a discharge-by-heating type discharge control unit. The discharge control unit includes a heating means including a heat generation portion provided with a heat generation body and a driver IC that controls heat generation of the heat generation body and a discharge portion including a discharge electrode disposed in accordance with the heat generation body, in which a head substrate including the heat generation portion and the discharge portion is disposed on a heat radiating plate.

The following effects can be achieved by this structure.

(1) Since the heating means includes the heat generation portion provided with the heat generation body and the driver IC that controls the heat generation of the heat generation body, the discharge electrode corresponding to the heated heat generation body by controlling the heat generation of the heat generation body can be heated.

(2) The discharge electrode, onto which a discharge control voltage (which denotes a voltage range in which an electric discharge is caused by heating although an electric discharge is not caused merely by applying a voltage) has been applied, is thermally controlled by the heat generation body, whereby thermions are emitted from the heated discharge electrode, and an electric discharge or light emission is caused, and, in an ion-generative atmosphere, ions are projected.

(3) The discharge time of the discharge electrode can be controlled by controlling the heat time of the discharge electrode heated by the heat generation body with the heating means, and the amount of ions to be generated or the amount of light to be emitted resulting from an electric discharge can be controlled.

(4) Since the ion-generation amount can be controlled merely by controlling the heat time by the discharge control unit, the area gradation on the ion-projected body onto which ions are projected can easily be carried out, and image quality can be improved.

(5) Since the head substrate is disposed on the heat radiating plate, heat generated by the heat generation portion can be promptly absorbed by the heat radiating plate and be radiated from the heat radiating plate, and hence the heat generation portion can be quickly cooled to improve responsibility to the stop of heating, and the driver IC and other elements can be reliably protected from heat.

The image forming apparatus as set forth in a seventh aspect includes the print head as set forth in any one of the first to sixth aspects.

With this structure, the following effects are achieved.

(1) An image can be formed by ion projection or light emission caused by an electric discharge from the print head, and an image-forming process can be simplified.

(2) Ion projection makes it possible to form an electrostatic latent image or form an image resulting from an oxidation-reduction reaction, whereas light emission of an electric discharge makes it possible to form an image on, for example, electronic paper using a photochromic compound that reacts to ultraviolet rays or visible rays.

Herein, this image forming apparatus can form an image on a recording medium that is pre-initialized and from which printing data has been erased. The surface of the recording medium can be uniformly electrified inside the image forming apparatus, and the recording medium can be initialized by providing an electrification roller or an electrification brush that serves as a restoring device. Therefore, rewriting can be repeatedly performed onto the recording medium.

Unnecessary records can be erased by projecting ions, which have a polarity reverse to a polarity exhibited when an image is formed, from the print head toward the recording medium in which an image has been formed, instead of providing the restoring device.

Twist ball type, electrophoretic type, or liquid crystal type electronic paper is suitably used as the recording medium that forms an image by ion projection. Additionally, an image can be formed on, for example, electronic paper using an organo-mineral nano-composite that is subjected to redox by metallic ions, such as bismuth ions, and is colorized or decolorized. Additionally, for example, electronic paper using a photochromic compound that reacts to light emission caused by an electric discharge can be used.

The invention as set forth in a eighth aspect is the image forming apparatus as set forth in the seventh aspect, in which recording is performed onto a recording medium in which a visible image appears in the inside of the recording medium in reaction to an electric charge generated by an electric discharge of the print head.

With this structure, the following effect can be achieved in addition to the effects of the seventh aspect.

(1) A visible image can be formed inside the recording medium in a noncontact manner by an electric discharge from the print head, and hence, with a smaller number of components, damage to the recording medium can be restricted to the minimum necessary, and excellent practicality can be achieved.

Herein, an earth electrode portion used to apply an electric field between the discharge electrode of the print head and the recording medium, or a positive-voltage application portion used to apply a positive voltage is disposed on the reverse side of the recording medium. Negative ions generated by the electric discharge can be attracted to the surface of the recording medium by applying a positive voltage, and can be reliably projected onto the recording medium, and hence image quality can be improved.

The invention as set forth in a ninth aspect is the image forming apparatus as set forth in the seventh aspect, which further includes an electrostatic latent image carrier that faces the print head.

With this structure, the following effect can be achieved in addition to the effects of the seventh aspect.

(1) Since the electrostatic latent image carrier facing the print head is provided, an electrostatic latent image can be formed on the surface of the electrostatic latent image carrier by projecting ions from the print head, and a visible image can be formed by subjecting the recording medium to electrostatic development by use of the electrostatic latent image. Therefore, the print head does not directly face the recording medium, and can be prevented from being stained.

Herein, any of carriers having various shapes, such as a drum-shaped carrier or a belt-shaped carrier, can be used as the electrostatic latent image carrier. What is required of the electrostatic latent image carrier is to have a surface capable of being electrified by ion projection. Therefore, the electrostatic latent image carrier is not limited to a photoconductor, and hence an insulator, such as alumite, can be used as the material of the electrostatic latent image carrier. If the electrostatic latent image carrier is a photoconductor, the surface thereof can be destaticized by projecting a beam of light, and, if the electrostatic latent image carrier is an insulator, the surface thereof can be destaticized by an AC voltage. If the electrostatic latent image carrier is an insulator, the insulator has stronger resistance to deterioration than the photoconductor, and hence excellent longevity can be achieved.

The invention as set forth in a tenth aspect is the image forming apparatus as set forth in the ninth aspect, which further includes a visualizing means for forming a visible image on a surface of the electrostatic latent image carrier based on an electrostatic latent image formed on a surface of the electrostatic latent image carrier, and a transferring means for transferring the visible image to a printing medium.

With this structure, the following effects can be achieved in addition to the effects of the ninth aspect.

(1) Since an electrostatic latent image is formed on the surface of the electrostatic latent image carrier by ion projection from the print head, an exposure optical system, such as a polygon mirror, is not required, and hence the structure can be simplified with a smaller number of components.

(2) A visible image can be formed on the surface of the electrostatic latent image carrier based on an electrostatic latent image by use of the visualizing means, and the visible image can be transferred to the printing medium by the transferring means and be recorded. Therefore, various mediums, such as OHP sheets and glossy paper in addition to regular paper, can be used as the printing medium, and excellent general versatility can be achieved.

Herein, the same carrier as above can be used as the electrostatic latent image carrier. Although a developing device that performs toner development is used as the visualizing means, the development may be performed with ink or according to another method. For example, a transfer fixing roller in which a roller surface made of a metal, such as aluminum, is covered with synthetic rubber, such as silicone rubber, is suitably used as the transferring means for transferring a visible image to the printing medium. If a pressure-fixed type toner is used when the toner development is performed, the toner is pressed by the transferring means, and, accordingly, a visible image can be transferred and fixed to the printing medium.

Preferably, the image forming apparatus includes a cleaner that physically scrapes off a toner remaining on the surface of the electrostatic latent image carrier after the transfer operation so as to clean the surface thereof and a static eraser that destaticizes the surface of the electrostatic latent image carrier prior to a writing operation (ion projection) performed by the print head. These make it possible to form an electrostatic latent image on the surface of the electrostatic latent image carrier in a stable state at any time, and hence excellent reliability can be achieved. Additionally, if an insulator, such as alumite, is used as the electrostatic latent image carrier, damage will not easily be caused by the scraping operation of the cleaner, and hence excellent longevity can be achieved.

EFFECTS OF THE INVENTION

As mentioned above, according to the print head of the present invention and the image forming apparatus including the print head, the following advantageous effects can be achieved.

According to the invention as set forth in the first aspect, the following effects are achieved.

(1) Since the heating means includes the driver IC that selectively energizes the heat generation body and that controls the heat generation of the heat generation body, it is possible to provide a print head that is small in size, that is superior in mass productivity, and that is capable of controlling the ion projection while heating the discharge electrode corresponding to the heated heat generation body by controlling the heat generation of the heat generation body at a low voltage.

(2) The discharge electrode, onto which a discharge control voltage (which denotes a voltage range in which an electric discharge is caused by heating although an electric discharge is not caused merely by applying a voltage) has been applied, is thermally controlled by the heat generation body. Therefore, it is possible to provide a print head superior in energy saving that can form an image such that thermions are emitted from the heated discharge electrode, and an electric discharge or light emission is caused, and, in an ion-generative atmosphere, ions are projected.

(3) Since the discharge time of the discharge electrode can be controlled by controlling the heat time of the discharge electrode heated by the heat generation body with the heating means, it is possible to provide a print head superior in controllability that can control the amount of ions to be generated or the amount of light to be emitted resulting from an electric discharge.

(4) Since the area gradation on the ion-projected body onto which ions are projected can easily be performed merely by controlling the ion-generation amount by the discharge control unit, it is possible to provide a print head that can improve image quality and that has high quality and excellent reliability.

(5) Since the surface on which the discharge electrode is disposed and the surface on which the driver IC is disposed are not flush with each other, a design restriction and a production restriction can be lightened. Therefore, it is possible to provide a print head superior in the design flexibility and the general versatility of being capable of increasing the degree of freedom to arrange the discharge electrode with respect to the recording medium or the electrostatic latent image carrier that can be variously shaped.

According to the invention as set forth in the second aspect, the following effects are achieved in addition to the effect of the first aspect.

(1) Since the way according to which the discharge electrode is arranged is the end-surface type, it is possible to provide a print head that can rectilinearly convey the recording medium without causing the recording medium and the driver IC to interfere with each other and that is suitable for a horizontal printer.

(2) Since the way according to which the discharge electrode is arranged is the end-surface type, it is possible to provide a print head that can be disposed without being bulky in the horizontal direction by decreasing the width of a part facing the electrostatic latent image carrier or the recording medium and that is superior in the general versatility of corresponding especially to electrostatic latent image carriers having various shapes.

According to the invention as set forth in the third aspect, the following effects are achieved in addition to the effect of the first aspect.

(1) Since the way according to which the discharge electrode is arranged is the edge type, it is possible to provide a print head that can rectilinearly convey the recording medium without causing the recording medium and the driver IC to interfere with each other and that is suitable for a horizontal printer.

(2) Since the way according to which the discharge electrode is arranged is the edge type, it is possible to provide a print head that can be disposed without being bulky in the height direction and that is superior in the general versatility of being capable of corresponding to electrostatic latent image carriers having various shapes.

According to the invention as set forth in fourth aspect, the following effects are achieved in addition to the effect of the first aspect.

(1) Since the way according to which the discharge electrode is arranged is the ridge type, it is possible to provide a print head that can rectilinearly convey the recording medium without causing the recording medium and the driver IC to interfere with each other and that is suitable for a horizontal printer.

(2) Since the way according to which the discharge electrode is arranged is the ridge type, it is possible to provide a print head that can be disposed without being bulky in the height direction and that is superior in the general versatility of being capable of corresponding to electrostatic latent image carriers having various shapes.

According to the invention as set forth in fifth aspect, the following effects are achieved in addition to the effects of any one of the first to fourth aspects.

(1) Since the high-pressure board and the discharge portion to apply a discharge control voltage onto the discharge portion can be electrically connected together by a short wire, and can be treated as a unit, it is possible to provide a print head that can easily be incorporated into the image forming apparatus without need to lay electric wires, that is superior in mass productivity, that can hardly impose a load on electric wires especially when an image is formed while moving the print head for scanning, and that can reduce the occurrences of defects in electric conductivity with excellent reliability.

According to the invention as set forth in the sixth aspect, the following effects are achieved.

(1) Since the heating means includes the driver IC that selectively energizes the heat generation body and that controls the heat generation of the heat generation body, it is possible to provide a print head that is small in size, that is superior in mass productivity, and that is capable of controlling the ion projection while heating the discharge electrode corresponding to the heated heat generation body by controlling the heat generation of the heat generation body at a low voltage.

(2) The discharge electrode, onto which a discharge control voltage (which denotes a voltage range in which an electric discharge is caused by heating although an electric discharge is not caused merely by applying a voltage) has been applied, is thermally controlled by the heat generation body. Therefore, it is possible to provide a print head superior in energy saving that can form an image such that thermions are emitted from the heated discharge electrode, and an electric discharge or light emission is caused, and, in an ion-generative atmosphere, ions are projected.

(3) Since the discharge time of the discharge electrode can be controlled by controlling the heat time of the discharge electrode heated by the heat generation body with the heating means, it is possible to provide a print head superior in controllability that can control the amount of ions to be generated or the amount of light to be emitted resulting from an electric discharge.

(4) Since the area gradation on the ion-projected body onto which ions are projected can easily be performed merely by controlling the ion-generation amount by the discharge control unit, it is possible to provide a print head that can improve image quality and that has high quality and excellent reliability.

(5) Since the head substrate is disposed on the heat radiating plate, heat generated by the heat generation portion can be promptly absorbed by the heat radiating plate and be radiated from the heat radiating plate, and hence the heat generation portion can be quickly cooled to improve responsibility to the stop of heating, and the driver IC and other elements can be reliably protected from heat.

According to the invention as set forth in the seventh aspect, the following effects are achieved.

(1) It is possible to provide an image forming apparatus that has a simple image forming process in which an image can be formed by ion projection or light emission by an electric discharge from the print head and that is superior in productivity.

(2) It is possible to provide an image forming apparatus that is superior in the general versatility of being capable of forming an electrostatic latent image and a visible image on various recording mediums by ion projection or light emission by an electric discharge.

According to the invention as set forth in eighth aspect, the following effect is achieved in addition to the effects of the seventh aspect.

(1) It is possible to provide an image forming apparatus that can form a visible image inside the recording medium in a noncontact manner by an electric discharge from the print head, that can restrict damage on the recording medium to the minimum necessary with a smaller number of components, and that is superior in mass productivity, in practicality, and in reliability.

According to the invention as set forth in the ninth aspect, the following effect is achieved in addition to the effects of the seventh aspect.

(1) Since a visible image can be formed by subjecting the recording medium to electrostatic development by use of an electrostatic latent image formed on the surface of the electrostatic latent image carrier by ion projection from the print head, it is possible to provide an image forming apparatus that can prevent stains on the print head without allowing the print head and the recording medium to directly face each other and that is superior in practicality and reliability.

According to the invention as set forth in the tenth aspect, the following effects are achieved in addition to the effect of the ninth aspect.

(1) Since the electrostatic latent image carrier on the surface of which an electrostatic latent image is formed by ion projection is provided, it is possible to provide an image forming apparatus that has a simple structure with a smaller number of components without an exposure optical system such as a polygon mirror, that is small in size, and that is superior in mass productivity.

(2) It is possible to provide an image forming apparatus that can transfer a visible image formed on the surface of the electrostatic latent image carrier by the visualizing means to the printing medium by the transferring means and that can print characters on various printing mediums such as OHP sheets and glossy paper in addition to regular paper, and that is superior in general versatility and practicality.

(3) Since an electrostatic latent image carrier that can form an electrostatic latent image only by selective electrification (electrostatic latent image formation electrification) by ion projection is not required to be a photoconductor, it is possible to provide an image forming apparatus that has a broad range of options to choose materials, that is superior in general versatility and mass productivity, and that is superior in longevity especially when an insulator is used as the electrostatic latent image carrier.

DESCRIPTION OF THE INVENTION

A description will be hereinafter given of a print head in a first embodiment of the present invention and an image forming apparatus including the print head with reference to the accompanying drawings.

Figure 1A:
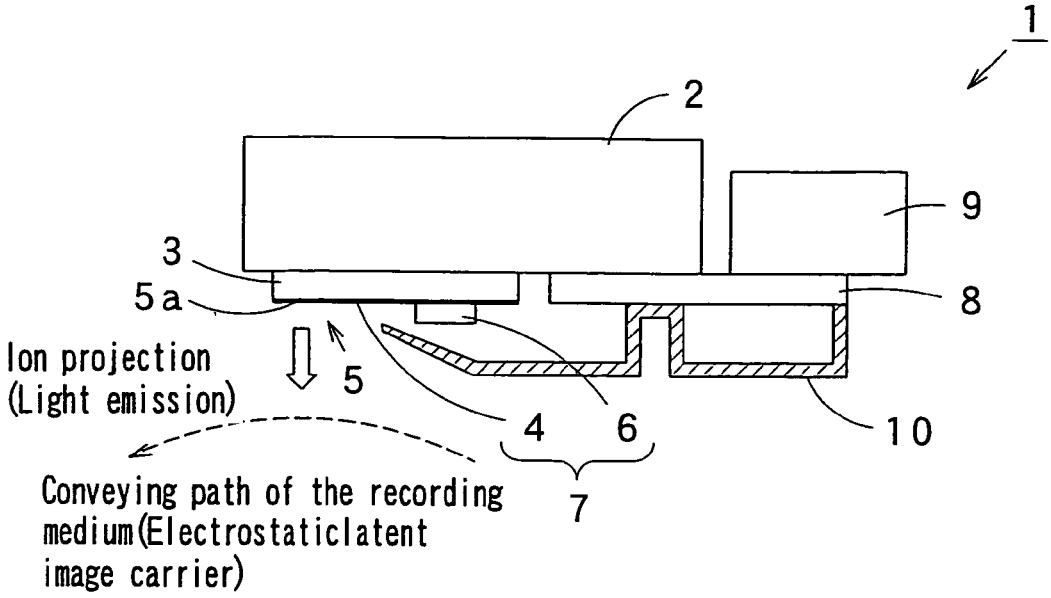
FIG. 1A is a schematic side view showing a use state of a print head in a first embodiment.
Figure 1B:
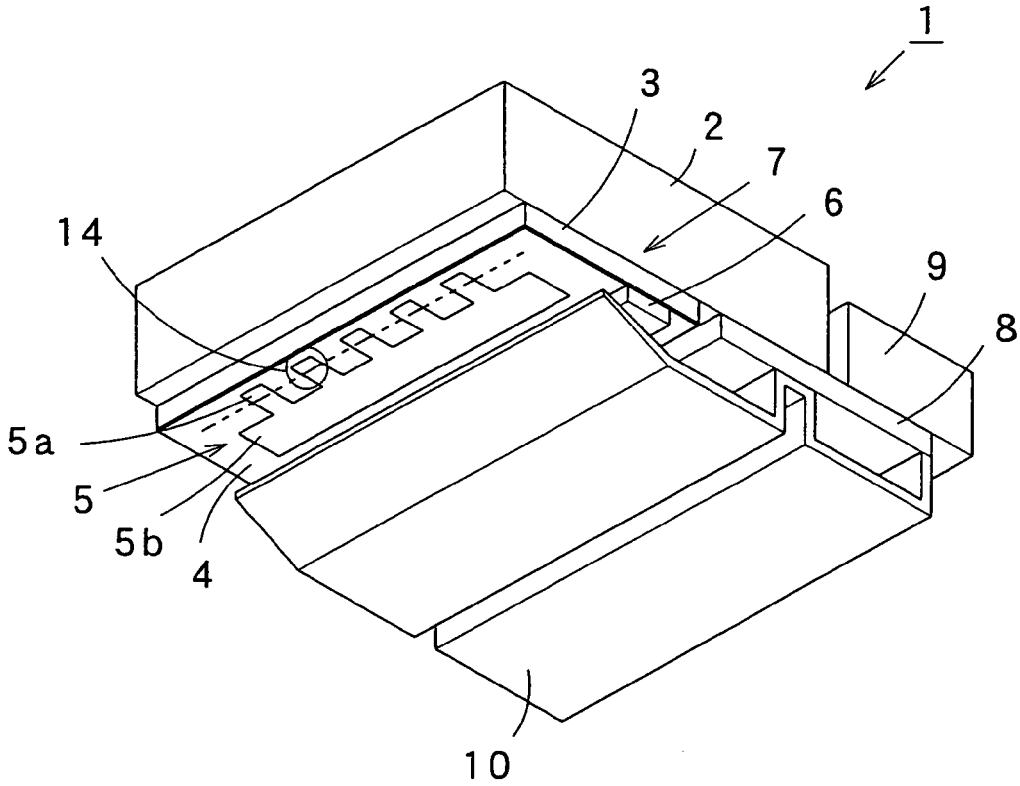
FIG. 1B is a schematic perspective view showing a main part of the print head in the first embodiment.

FIG. 1A is a schematic side view showing a use state of a print head in a first embodiment, and FIG. 1B is a schematic perspective view showing a main part of the print head in the first embodiment.

In FIGS. 1A and 1B, reference character 1 denotes a print head in the first embodiment of the present invention, reference character 2 denotes a heat radiating plate of the print head 1 made of a material such as aluminum, reference character 4 denotes a head substrate of the print head 1 that is formed on a substrate 3, which is made of, for example, ceramic and on which a heat generation portion and a discharge portion 5 described later are stacked, the substrate 3 being disposed on the heat radiating plate 2, reference character 5*a* denotes a plurality of discharge electrodes of the discharge portion 5 formed like comb teeth, reference character 5*b* denotes a common electrode of the discharge portion 5 to which an end of the discharge electrode 5*a* is connected, reference character 7 denotes a discharge control unit of the print head 1 that includes the head substrate 4 and a driver IC 6, reference character 8 denotes a printed circuit board that has a connector 9 to be electrically connected to the outside and that is disposed on the heat radiating plate 2, and reference character 10 denotes an IC cover with which the driver IC 6 and the printed circuit board 8 are covered and protected.

Next, a structure of the head substrate will be described in detail.

Figure 2:
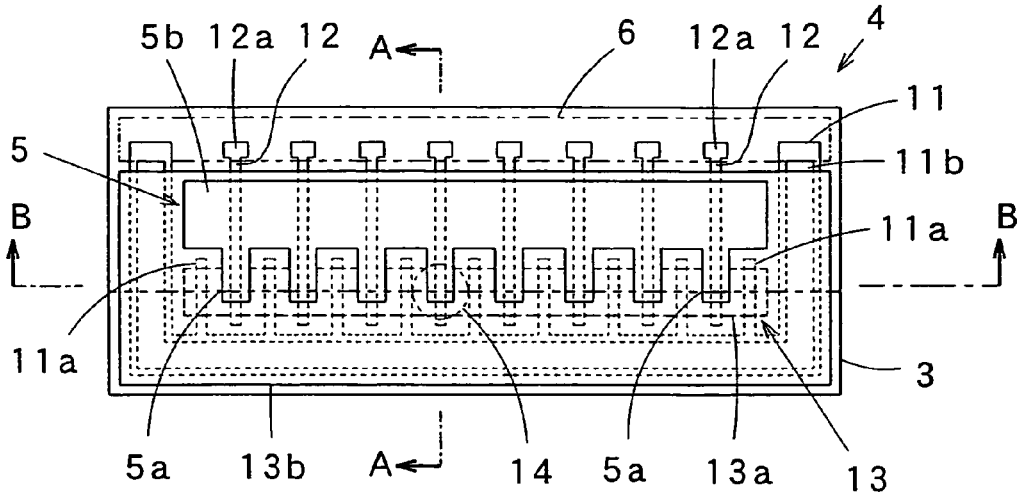
FIG. 2 is a schematic plan view of a head substrate of the print head in the first embodiment.
Figure 3A:
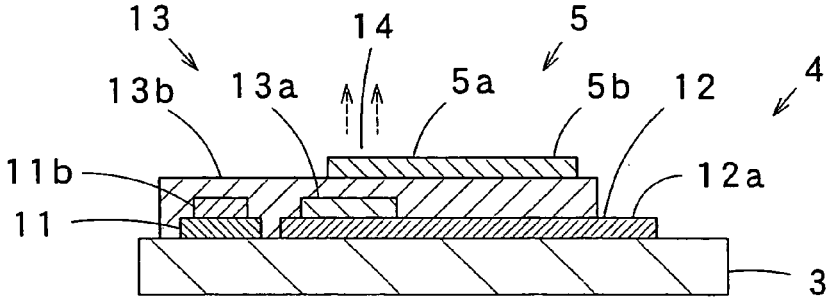
FIG. 3A is a schematic cross-sectional view along line A-A of FIG. 2.
Figure 3B:
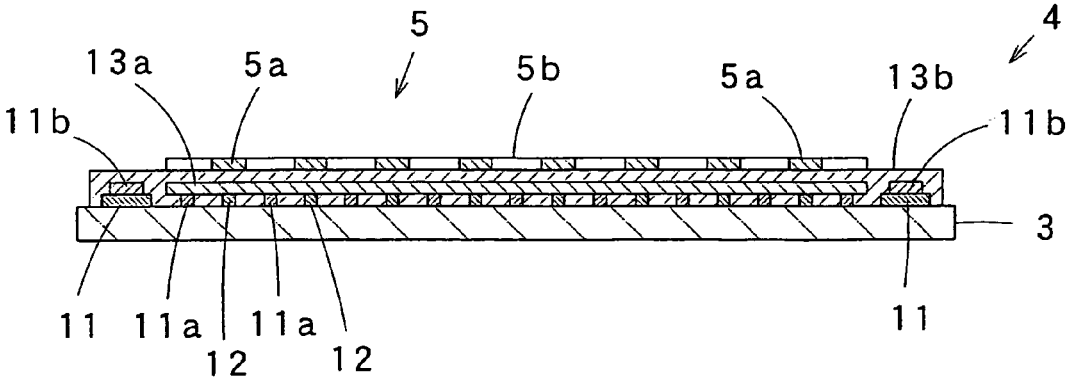
FIG. 3B is a schematic cross-sectional view along line B-B of FIG. 2.
Figure 4:
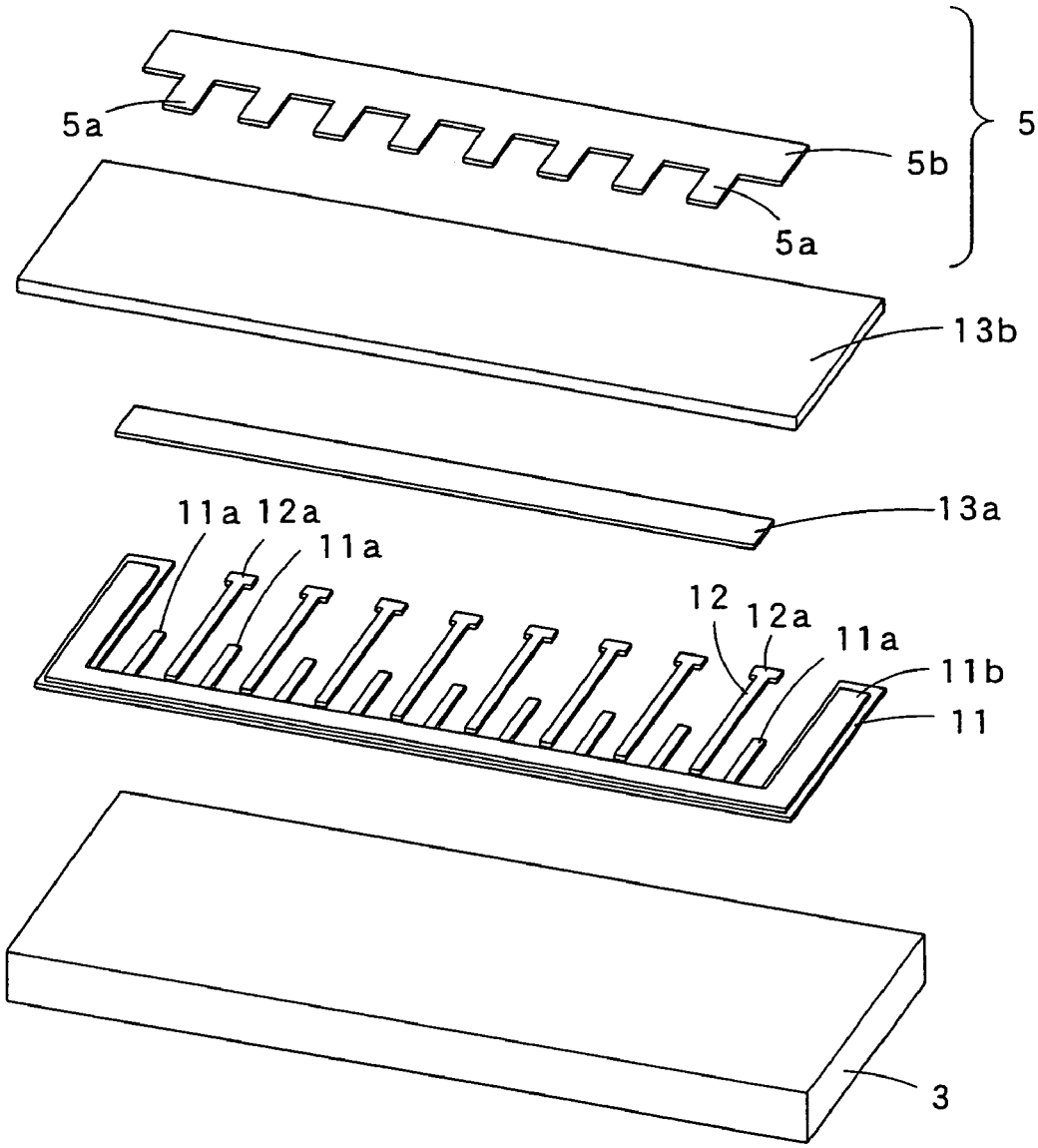
FIG. 4 is an exploded schematic perspective view of the head substrate of the print head in the first embodiment.

FIG. 2 is a schematic plan view of the head substrate of the print head in the first embodiment, FIG. 3A is a schematic cross-sectional view along line A-A of FIG. 2, FIG. 3B is a schematic cross-sectional view along line B-B of FIG. 2, and FIG. 4 is an exploded schematic perspective view of the head substrate of the print head in the first embodiment.

In FIG. 2 to FIG. 4, reference character 11 denotes a common conductor pattern for heat generation that is connected to a plurality of comb teeth-shaped electrodes 11*a* for heat generation and that is formed on the upper surface of the substrate 3, reference character 11*b* denotes a common electrode for heat generation that is disposed on the upper surface of the common conductor pattern 11 for heat generation, reference character 12 denotes an individual electrode for heat generation that is formed on the upper surface of the substrate 3 alternately with the comb teeth-shaped electrodes 11*a* for heat generation, reference character 12*a* denotes a bonding pad formed on an end of the individual electrode 12 for heat generation, reference character 13 denotes a heat generation portion of the discharge control unit 7, reference character 13*a* denotes a heat generation body of the heat generation portion 13 that is electrically connected to the upper parts of the comb teeth-shaped electrodes 11*a* for heat generation and the individual electrode 12 for heat generation, reference character 13*b* denotes a heat generation portion insulating film formed on the upper surface of the substrate 3 excluding the end of the common electrode 11*b* and the end of the individual electrode 12 for heat generation, and reference character 14 denotes a discharge generating portion of the discharge electrode 5*a* where an electric discharge is caused by being heated by the heat generation body 13*a*.

The discharge portion 5 described above is insulated from the heat generation portion 13 by means of the heat generation portion insulating film 13*b*, and the plurality of discharge electrodes 5*a* correspond to the position of the individual electrode 12 for heat generation while facing the heat generation body 13*a*.

Next, a structure of the discharge control unit will be described in detail.

Figure 5:
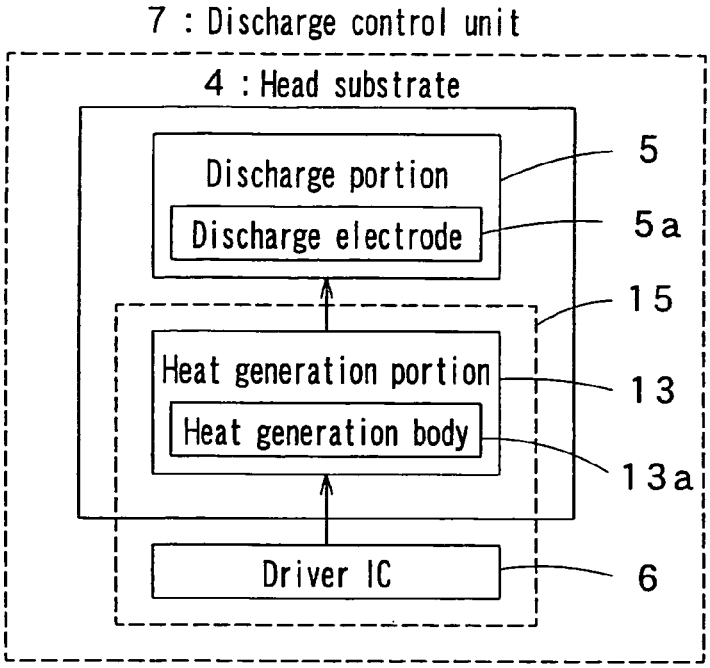
FIG. 5 is a block diagram of a discharge control unit of the print head in the first embodiment.

FIG. 5 is a block diagram of the discharge control unit of the print head in the first embodiment.

In FIG. 5, the head substrate 4 includes the discharge portion 5 and the heat generation portion 13. A heating means 15 is to control the heat generation of the heat generation body 13*a* of the heat generation portion 13 by the driver IC 6 electrically connected to the heat generation portion 13. The discharge control unit 7 employing a discharge-by-heating method controls an electric discharge from the discharge electrode 5*a* by controlling the heating to the discharge electrode 5*a* of the discharge portion 5 to which a discharge control voltage (which denotes a voltage range in which an electric discharge is caused by heating although an electric discharge is not caused merely by applying a voltage) is applied by the heating means 15.

Heat generated by the heat generation portion 13 can be promptly absorbed by the heat radiating plate 2, and can be radiated from the heat radiating plate 2 by disposing the head substrate 4 on the heat radiating plate 2. As a result, it becomes possible to quickly cool the heat generation portion 13 so as to improve responsibility to the heating stop. Additionally, the driver IC 6 and other elements can be protected against heat so as to obtain excellent reliability. If a rugged part, such as a groove, is formed in the surface of the heat radiating plate 2, the surface area of the heat radiating plate 2 can be increased, and the efficiency of heat radiation can be improved.

Next, a method for producing the head substrate will be described in detail.

Figure 6:
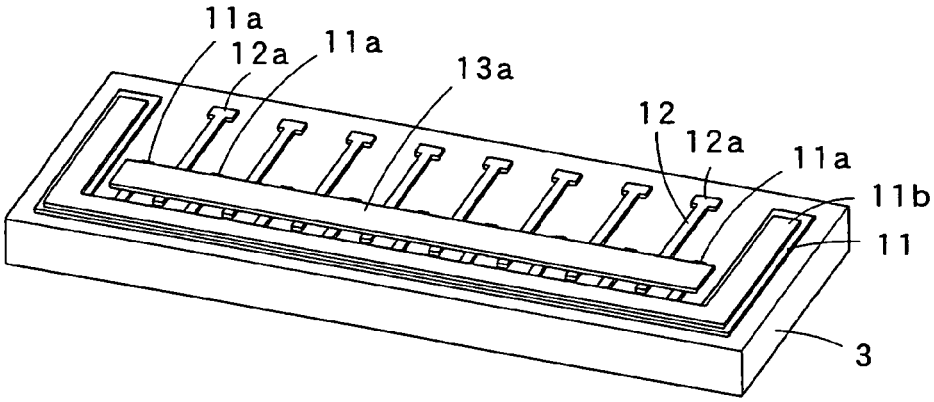
FIG. 6 is a schematic perspective view showing a step of forming a heat generation portion of the head substrate of the print head in the first embodiment.
Figure 7:
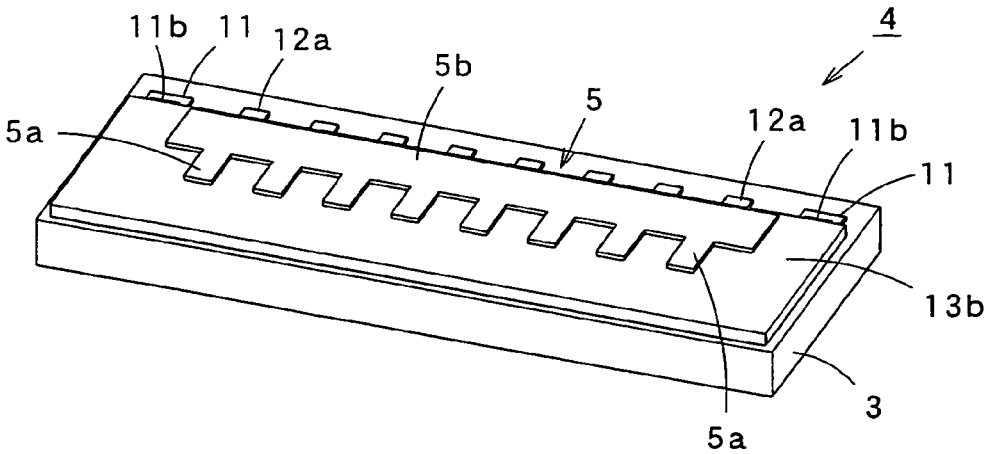
FIG. 7 is a schematic perspective view showing a step of forming a discharge portion of the head substrate of the print head in the first embodiment.

FIG. 6 is a schematic perspective view showing a step of forming a heat generation portion of the head substrate of the print head in the first embodiment, and FIG. 7 is a schematic perspective view showing a step of forming a discharge portion of the head substrate of the print head in the first embodiment.

First, the heating-portion forming step will be described.

In FIG. 6, a conductor, such as a gold paste, is first printed on the surface of the substrate 3 that is made of, for example, a ceramic material and that is shaped like a long plate, and then the plurality of comb teeth-shaped electrodes 11*a* for heat generation connected by the common conductor pattern 11 for heat generation and the individual electrode 12 for heat generation are formed by etching. Thereafter, the band-shaped heat generation body 13*a* is formed by printing $TaSiO_2$ or $RuO_2$ on the upper parts of the comb teeth-shaped electrodes 11*a* for heat generation and the individual electrode 12 for heat generation. Further, the common electrode 11*b* is formed by printing a silver paste or the like on the upper surface of the common conductor pattern 11.

A bonding pad 12*a* is formed on the end of the individual electrode 12 for heat generation, whereby the connection with the driver IC 6 by wire bonding can easily be performed.

Preferably, the heating means 15 is structured in the same way as in a thermal print head used in a conventional thermal type facsimile apparatus. In this case, a conventional step of producing a thermal print head can be followed, and the discharge control unit 7 can be produced at low cost by using the producing apparatus.

In this embodiment, the heat generation body 13*a* of the heat generation portion 13 is shaped like a band, and the comb teeth-shaped electrodes 11*a* for heat generation and the individual electrode 12 for heat generation are alternately disposed, and an electric current is passed through the single individual electrode 12 for heat generation occupying each center and through the comb teeth-shaped electrodes 11*a* for heat generation between which the individual electrode 12 for heat generation is disposed. As a result, an arbitrary part of the heat generation body 13*a* corresponding to the position of the discharge generating portion 14 of each discharge electrode 5*a* is selectively allowed to generate heat, and the discharge electrode 5*a* is heated. However, without being limited to this manner, it is primarily recommended to form a structure in which the discharge generating portion 14 of each discharge electrode 5*a* can be selectively heated.

Next, the discharging-portion forming step will be described.

In FIG. 7, the heat generation portion insulating film 13*b* is formed by printing an insulator made of glass, ceramic, mica, or synthetic resin on the surface of the substrate 3 excluding each end of the common electrode 11*b* for heat generation and each end of the individual electrode 12 for heat generation. What is required of the heat generation portion insulating film 13*b* is that the heat generation portion insulating film 13*b* can protect and insulate the common electrode 11*b* for heat generation, the individual electrode 12 for heat generation, the heat generation body 13*a*, etc. Preferably, the heat generation portion insulating film 13*b* is made of a highly thermal conductive material, such as SiAl, $SiO_2$, SiC, polyimide, or aramid, which is capable of efficiently transmitting the heat of the heat generation body 13*a* to the discharge electrode 5*a*.

The optimum thickness of the heat generation portion insulating film 13*b* depends on a material to be used, however, 4 μm to 40 μm if glass is used. The reason is understood from the fact that insulation properties are liable to be easily lowered in proportion to a decrease in thickness of the heat generation portion insulating film 13*b* from 4 μm, whereas there is a need to increase the discharge control voltage to be applied to the discharge portion 5 or increase the heating value of the heat generation body 13*a*, and energy saving is liable to be easily lowered in proportion to an increase in thickness of the heat generation portion insulating film 13*b* from 40 μm. Insulation properties and thermal conductivity can be excellently harmonized, and an electric discharge can be stably performed by setting the film thickness of the heat generation portion insulating film 13*b* at 4 μm to 40 μm.

Additionally, excellent reliability can be achieved, because the possibility that pinholes will be overlapped with each other can be lowered, and the heat generation portion 13 can be reliably insulated even if pinholes are generated by painting every one time when a plurality of printing operations are performed for the single heat generation portion insulating film 13*b*.

Thereafter, the plurality of discharge electrodes 5*a* that face the individual electrode 12 for heat generation of the heating means 15 and the common electrode 5*b* by which these discharge electrodes 5*a* are connected together are formed on the upper part of the heat generation portion insulating film 13*b*. Preferably, to form the discharge electrode 5*a* and the common electrode 5*b*, a metal, such as gold, silver, copper, or aluminum, is used in such a way that the metal is first formed by vapor deposition, sputtering, or printing, and is then etched to form a pattern. Instead, another conductive material, such as carbon, may be used.

In this embodiment, the discharge electrode 5*a* has a substantially rectangular shape. However, without being limited to this, the discharge electrode 5*a* may be formed to have a trapezoidal shape, a semicircular shape, or a shape obtained by a combination of the trapezoidal shape and the semicircular shape. Additionally, since the discharge generating portion 14 of the discharge electrode 5*a* can make a greater amount of discharge from an area near its edge, a plurality of concavo-convex parts may be formed on the outer periphery of the discharge electrode 5*a* so that the peripheral length near the edge becomes long. The amount of ions to be projected can be increased by increasing the amount of electric discharge from the discharge generating portion 14, and, as a result, the discharge control unit 7 can achieve excellent energy saving and excellent efficiency. Additionally, since the discharge control voltage to be applied to the discharge electrode 5*a* can be set low, the discharge electrode 5*a* can achieve excellent longevity.

Next, a modification of the head substrate will be described.

Figure 8A:
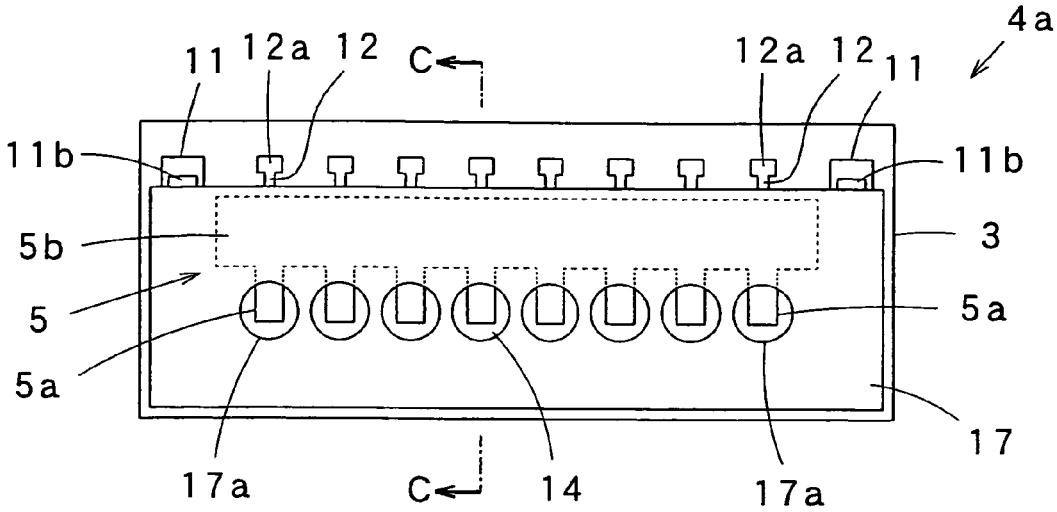
FIG. 8A is a schematic plan view showing a first modification of the head substrate of the print head in the first embodiment.
Figure 8B:
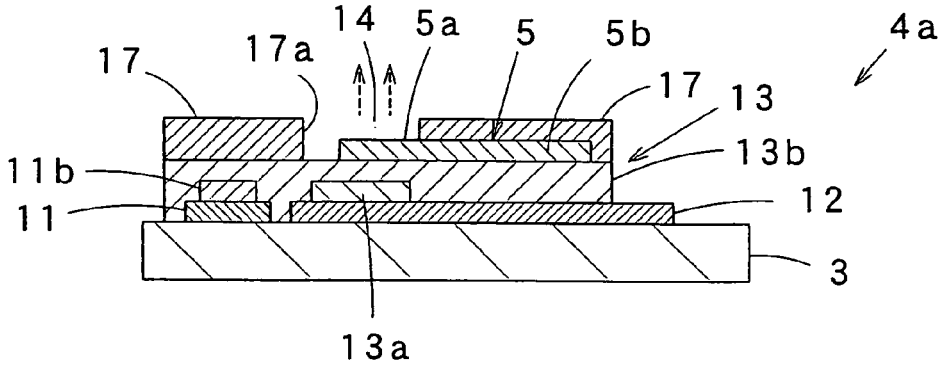
FIG. 8B is a schematic cross-sectional view along line C-C of FIG. 8A.

FIG. 8A is a schematic plan view showing a first modification of the head substrate of the print head in the first embodiment, and FIG. 8B is a schematic cross-sectional view along line C-C of FIG. 8A.

In FIGS. 8A and 8B, the first modification of the head substrate in the first embodiment differs from the first embodiment in the fact that a head substrate 4*a* has a coating film 17 provided on the surface of the discharge portion 5 and that the coating film 17 has a substantially circular opening 17*a* at a position (near the heat generation body 13*a*) corresponding to the discharge generating portion 14 of each discharge electrode 5*a*. The coating film 17 is made of the same insulator as the heat generation portion insulating film 13*b* mentioned above. Instead of forming the plurality of independent openings 17*a*, an opening like a long hole opening may be formed extending over the plurality of discharge electrodes 5*a*.

Since a step (i.e., a level difference) can be formed between the surface of the discharge generating portion 14 of the discharge electrode 5*a* and the surface of the coating film 17, a gap between the discharge generating portion 14 of the discharge electrode 5*a* and the electrostatic latent image carrier, or the like, which faces the discharge generating portion 14 of the discharge electrode 5*a* can be kept constant, so that the contact between the discharge electrode 5*a* and the electrostatic latent image carrier can be prevented, and an electric discharge can be stably performed from the discharge generating portion 14.

Figure 9:
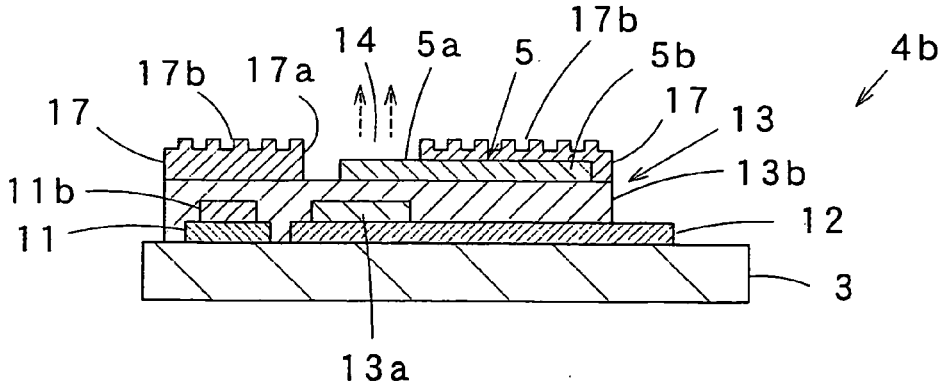
FIG. 9 is a schematic cross-sectional view showing a second modification of the head substrate of the print head in the first embodiment.

FIG. 9 is a schematic cross-sectional view showing a second modification of the head substrate of the print head in the first embodiment.

The second modification of the head substrate differs from the first modification in the fact that a concavo-convex part 17*b* is formed on the surface of the coating film 17 of the head substrate 4*b*.

This concavo-convex part 17*b* makes it possible to extend the surface distance of the coating film 17 and to increase the electric resistance of the surface, and, as a result, the electric leakage from the discharge generating portion 14 of the discharge electrode 5*a* to its surroundings can easily be prevented.

Figure 10A:
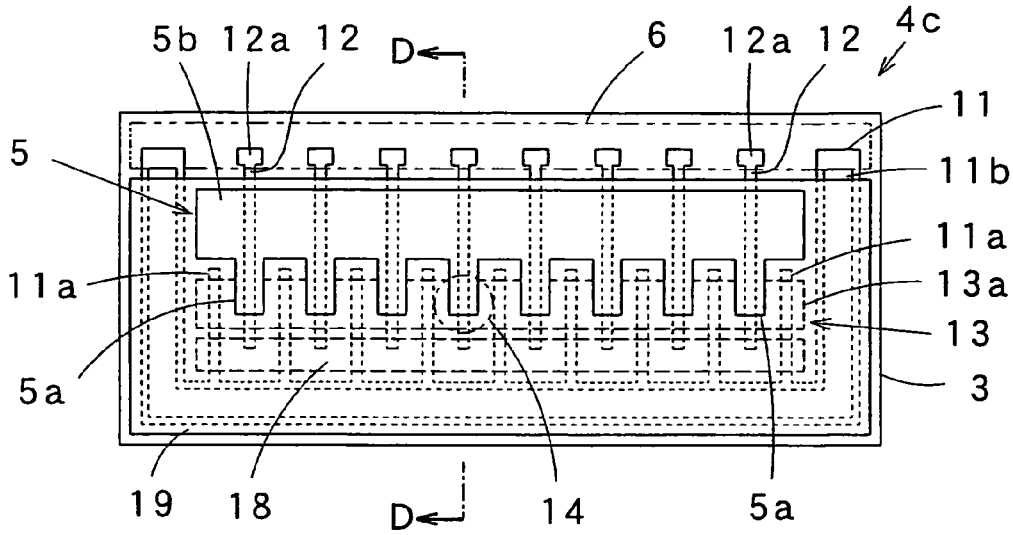
FIG. 10A is a schematic plan view showing a third modification of the head substrate of the print head in the first embodiment.
Figure 10B:
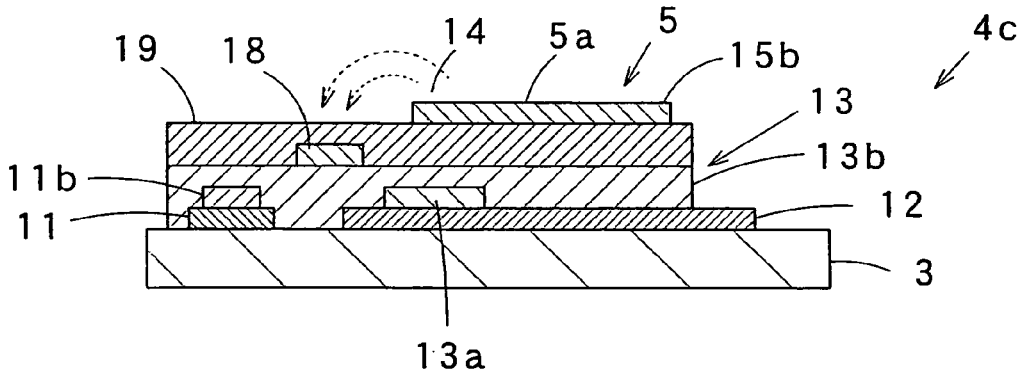
FIG. 10B is a schematic cross-sectional view along line D-D of FIG. 10A.

FIG. 10A is a schematic plan view showing a third modification of the head substrate of the print head in the first embodiment, and FIG. 10B is a schematic cross-sectional view along line D-D of FIG. 10A.

The third modification of the head substrate differs from the first embodiment in the fact that an induction electrode 18 is formed on the heat generation portion insulating film 13*b* horizontally apart from the end of the discharge electrode 5*a* of the head substrate 4*c* closer to the heat generation body 13*a* and that an induction electrode insulating film 19 with which the induction electrode 18 is covered is formed between the heat generation portion insulating film 13*b* and the discharge portion 5.

The induction electrode insulating film 19 is made of a material such as glass, ceramic, mica, or resin, and is formed by screen printing, vapor deposition, or sputtering.

The induction electrode 18 is shaped like a band on the heat generation portion insulating film 13*b*, and is grounded. When a side of, for example, a recording medium onto which ions are projected is grounded, ions are projected onto an ion-projected body in the same way as in a structure having no induction electrode 18 although an electric discharge is caused in such a way as to be pulled by the induction electrode 18.

The induction electrode insulating film 19 may be formed only on the induction electrode 18, and the discharge portion 5 may be formed on the heat generation portion insulating film 13*b*. Alternatively, the induction electrode 18 is formed on, for example, the upper part of the common electrode 5*b* of the discharge portion 5 formed on the heat generation portion insulating film 13*b*, with the induction electrode insulating film 19 therebetween.

With this structure, a gap between the discharge electrode 5*a* of the discharge portion 5 and the induction electrode 18 can always be kept constant, and an electric discharge can be reliably caused by applying a voltage between the discharge electrode 5*a* and the induction electrode 18.

A method for driving the thus structured print head will be described.

Figure 11:
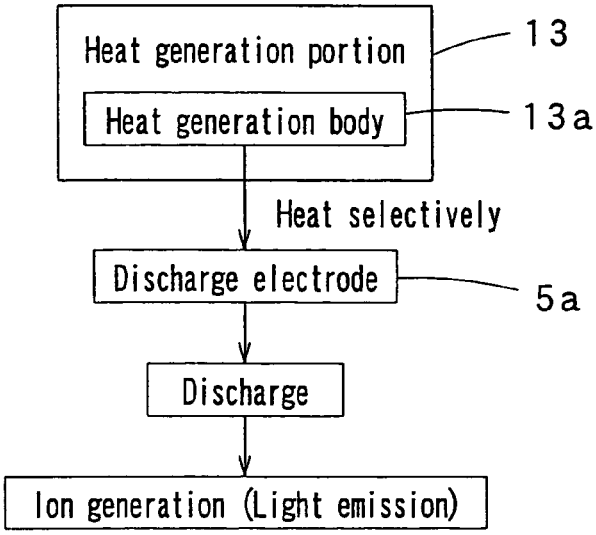
FIG. 11 shows an ion projection method of the print head in the first embodiment of the present invention.

FIG. 11 shows an ion projection method of the print head in the first embodiment of the present invention.

A value resulting from various, possible combinations can be given as the numerical value of an AC voltage or a DC voltage used as a discharge control voltage that is applied to the discharge electrode 5*a* (the common electrode 5*b*) of the discharge portion 5. In this embodiment, as an example, a voltage of −700V is superimposed on AC550Vpp (triangular wave 1 kHz) with a DC bias, and is applied to the discharge electrode 5*a* of the discharge portion 5. The discharge control voltage is applied to the discharge electrode 5*a* from a high-pressure board (not shown) connected to the common electrode 5*b* of the discharge portion 5.

The reason why the voltage of AC550Vpp was superimposed thereon is to obtain the stability of the electric discharge. The heat generation body 13*a* was heated at a low voltage of 24V. A 5V-driven device that responses to a low withstand voltage was used as the driver IC 6 used as a switch to heat the heat generation body 13*a*.

An electric discharge from the discharge generating portion 14 of the discharge electrode 5*a* is not caused merely by applying the discharge control voltage described in FIG. 5 to the discharge electrode 5*a* of the discharge portion 5. As described in FIG. 5, the discharge electrode Sa is selectively heated (200 to 300° C.) by the heat generation body 13*a* while controlling the heat generation portion 13 by means of the driver IC 6, and, as a result, thermions are emitted from the discharge generating portion 14 of the discharge electrode 5*a* selectively heated, and an electric discharge is caused by the discharge control voltage as shown by the arrow in FIG. 3 and FIG. 8 to FIG. 10. Resulting from the electric discharge, ions are generated in an ion-generative atmosphere, and are projected onto the electrostatic latent image carrier and the recording medium as shown in FIG. 1A. An electrostatic latent image is then formed on the surface of the electrostatic latent image carrier onto which the ions have been projected. An electrostatic latent image or an image resulting from an oxidation reduction reaction can be formed on the recording medium, depending on the kind of the recording medium. An image can also be formed on a recording medium that can react to the emission of light such as ultraviolet rays or visible rays.

Positive and negative ions are generated only when an AC voltage is applied to the discharge electrode 5*a*. To select only negative ions, a negative DC voltage is superimposed on an AC voltage. On the other hand, to select only positive ions, a positive DC voltage is superimposed on an AC voltage.

The flat-type print head 1 of FIGS. 1A and 1B is characterized in that the surface on which the discharge electrode 5*a* is disposed and the surface on which the driver IC 6 is disposed are flush with each other. Since the discharge portion 5 and the heat generation portion 13 are formed on the flat substrate 3, mass productivity can be achieved to facilitate production.

Since the print head according to the first embodiment is structured as above, the following effects are achieved.

(1) Since the heating means 15 includes the heat generation portion 13 having the heat generation body 13*a* and the driver IC 6 by which the heat generation of the heat generation body 13*a* is controlled, the discharge electrode 5*a* corresponding to the heat generation body 13*a* that has generated heat can be heated while controlling the heat generation of the heat generation body 13*a* at a low voltage.

(2) The discharge electrode 5*a*, onto which a discharge control voltage (which denotes a voltage range in which an electric discharge is caused by heating although an electric discharge is not caused merely by applying a voltage) has been applied, is thermally controlled by the heat generation body 13*a*, whereby thermions are emitted from the heated discharge electrode 5*a*, and an electric discharge or light emission is caused, and, in an ion-generative atmosphere, ions are projected.

(3) The discharge time of the discharge electrode 5*a* can be controlled by controlling the heat time of the discharge electrode 5*a* heated by the heat generation body 13*a*, and the amount of ions to be generated or the amount of light to be emitted resulting from an electric discharge can be controlled.

(4) Since the ion-generation amount can be controlled by the discharge control unit 7, the area gradation on the ion-projected body onto which ions are projected can easily be carried out, and image quality can be improved.

(5) Since the heating means 15 is provided, an electric discharge can be caused by always applying a discharge control voltage onto the discharge portion 5 and giving a low heat temperature of the discharge electrode 5*a* to the heat generation body 13, and hence excellent energy saving can be achieved.

(6) Since the head substrate 4 (4*a*, 4*b*, 4*c*) is disposed on the heat radiating plate 2, heat generated by the heat generation portion 13 can be promptly absorbed by the heat radiating plate 2 and be radiated from the heat radiating plate 2, and hence the heat generation portion 13 can be quickly cooled to improve responsibility to the stop of heating, and the driver IC 6 and other elements can be reliably protected from heat.

(7) Since the IC cover 10 is disposed on the surface of the driver IC 6, the driver IC 6 can be reliably prevented and protected from being brought into contact with, for example, the recording medium, and hence excellent reliability can be achieved.

Second Embodiment

A print head according to a second embodiment of the present invention will be hereinafter described with reference to the accompanying drawings.

Figure 12A:
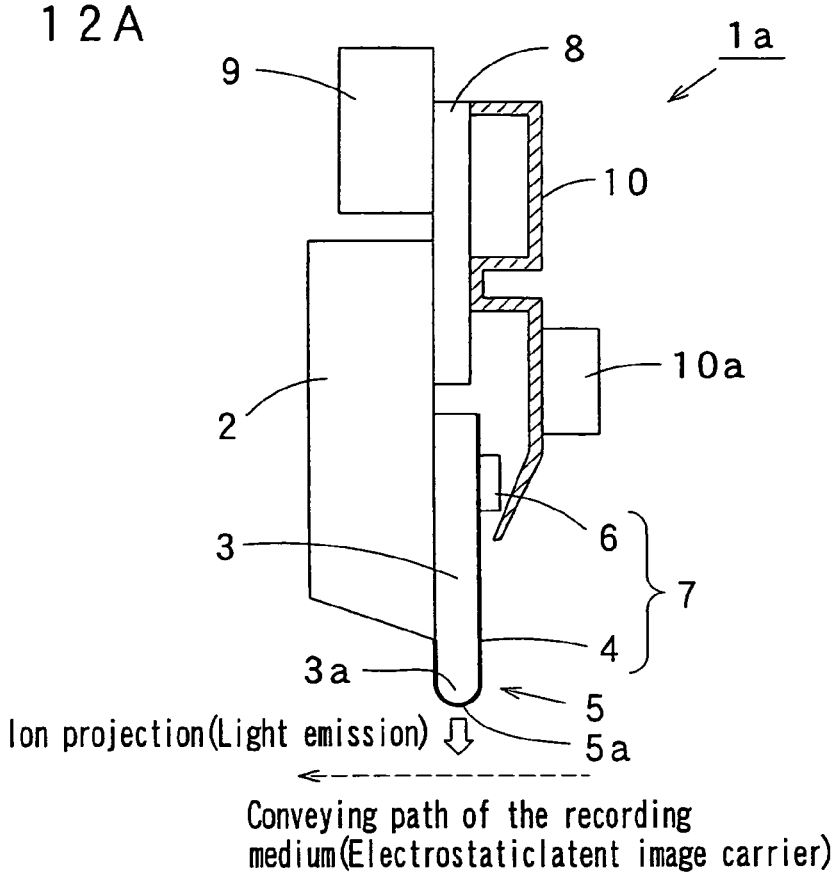
FIG. 12A is a schematic side view showing a use state of a print head in a second embodiment.
Figure 12B:
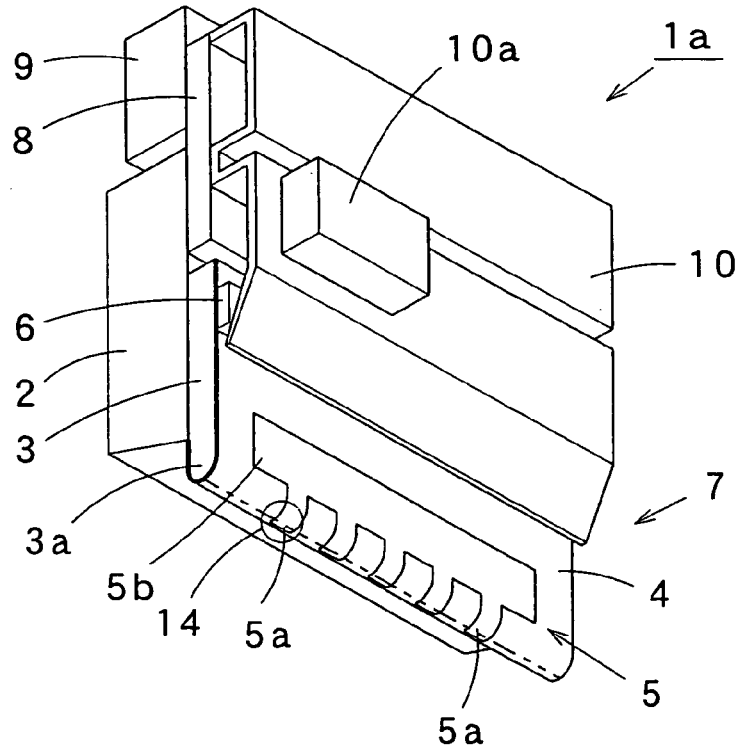
FIG. 12B is a schematic perspective view showing a main part of the print head in the second embodiment.

FIG. 12A is a schematic side view showing a use state of the print head in the second embodiment, and FIG. 12B is a schematic perspective view showing a main part of the print head in the second embodiment.

In FIGS. 12A and 12B, the print head 1*a* according to the second embodiment of the present invention differs from the print head according to the first embodiment in the fact that the print head 1*a* is an end-surface type in which the discharge generating portion 14 of the discharge electrode 5*a* is disposed on the end surface part 3*a* of the substrate 3 on which the driver IC 6 is disposed and in the fact that the high-pressure board 10*a* that is connected to the common electrode 5*b* of the discharge portion 5 by means of an electric wire (not shown) and that supplies a high voltage to the discharge electrode 5*a* is disposed on the backface of the IC cover 10.

The driver IC 6 and the IC cover 10 never interfere with the electrostatic latent image carrier and the recording medium even when the print head 1*a* is disposed so that the surface of the discharge electrode 5*a* becomes substantially parallel to the electrostatic latent image carrier and the recording medium as shown in FIG. 12A. Additionally, the print head 1*a* can be disposed under a densely arranged state, and can be suitably used especially when colorization is performed in the image forming apparatus.

Additionally, since the print head 1*a* and the high-pressure board 10*a* can be moved together when an image is formed while moving the print head 1*a* for scanning, a load or the like can be hardly imposed on electric wires, and the occurrences of defects in electric conductivity can be reduced.

This high-pressure board 10*a* can also be used for the print head in the first embodiment mentioned above or in third and fourth embodiments described later.

Although the substrate 3 is shaped like a flat plate in this embodiment, the end surface part 3*a* of the substrate 3 may be bent toward the surface of the substrate 3 so that the substrate 3 is formed substantially in the shape of the letter "L" or "<."

Since the print head according to the second embodiment is structured as above, the following effects are achieved in addition to the effects in the first embodiment.

(1) Since the driver IC 6 and the discharge electrode 5*a* are disposed substantially perpendicularly to each other by disposing the discharge electrode 5*a* on the end surface part 3*a* of the substrate 3 on which the driver IC 6 is disposed, the electrostatic latent image carrier and the recording medium never interfere with the driver IC 6 or other elements jutting from the substrate 3. Therefore, the degree of freedom to arrange the print head 1*a* can be increased, and general versatility can be improved.

(2) Since the print head 1*a* is an end-surface type in which the driver IC 6 and the discharge electrode 5*a* are disposed substantially perpendicularly to each other, a recording medium, such as digital paper, which should not be bent, can be conveyed rectilinearly, and hence the print head 1*a* can be suitably used in a horizontal printer.

(3) Since the electrode 5*a* is disposed on the end surface part 3*a* of the substrate 3, the width of a part facing the electrostatic latent image carrier or the recording medium is small, and hence the print head can be disposed without being bulky in the horizontal direction. Especially, the print head can correspond to electrostatic latent image carriers having various shapes, and excellent general versatility can be achieved.

(4) Since the high-pressure board 10*a* electrically connected to the discharge portion 5 is provided, an electric wire used to apply a discharge control voltage can be shortened, and reliability can be improved. Since the print head 1*a* and the high-pressure board 10*a* can be moved together especially when an image is formed while moving the print head 1*a* for scanning, a load can be hardly imposed on electric wires, and the occurrences of defects in electric conductivity can be reduced.

(5) Since the high-pressure board 10*a* can be treated together with the print head 1*a*, and since there is no need to lay electric wires, the print head 1*a* can easily be incorporated into an image forming apparatus, and mass productivity can be achieved.

Third Embodiment

A print head according to a third embodiment of the present invention will be hereinafter described with reference to the accompanying drawings.

Figure 13A:
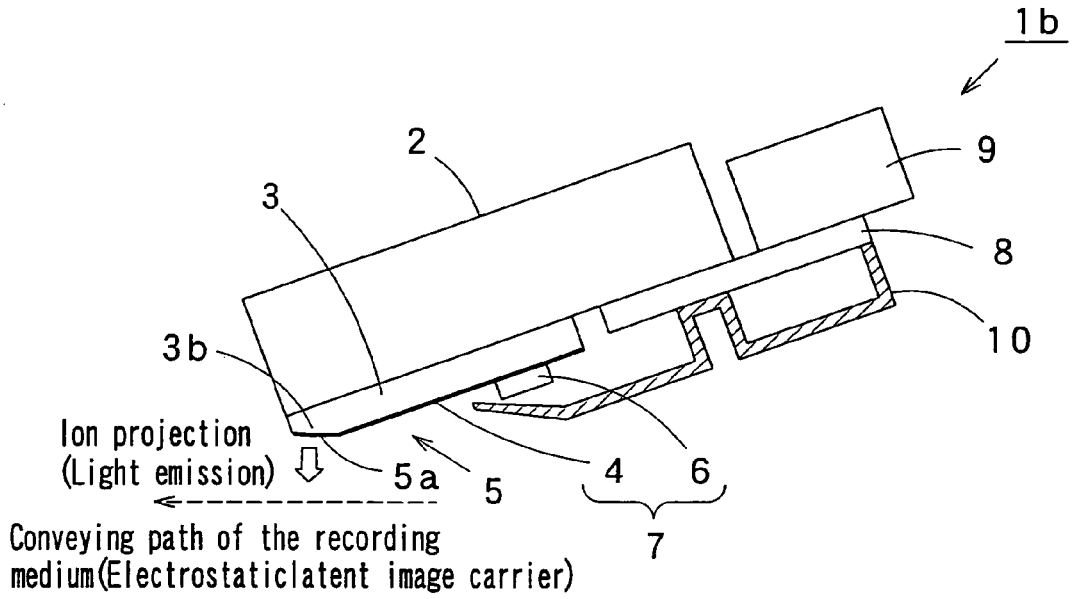
FIG. 13A is a schematic side view showing a use state of a print head in a third embodiment.
Figure 13B:
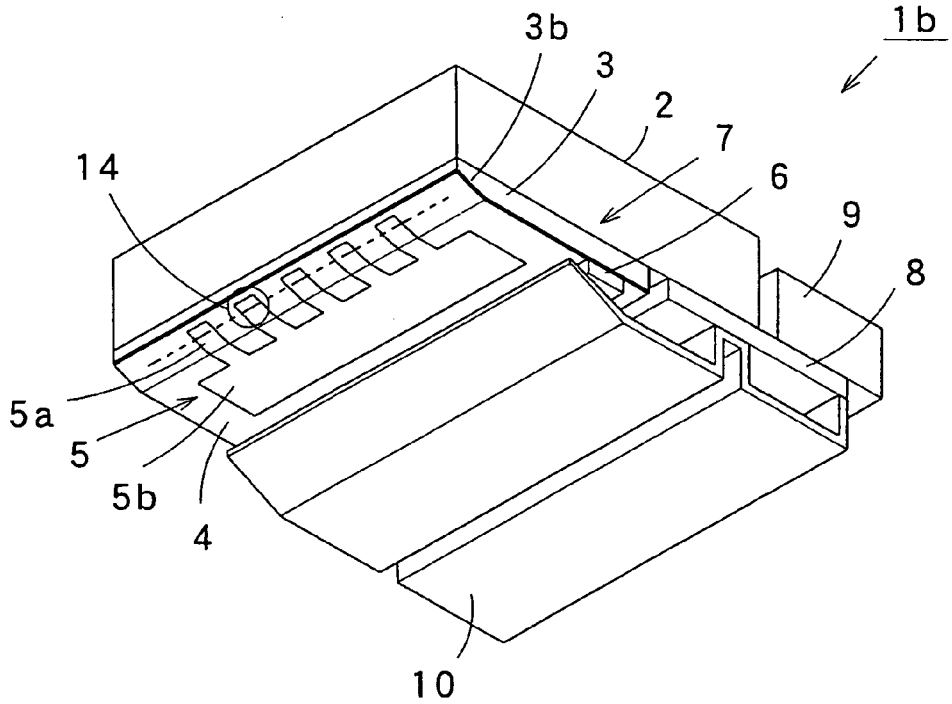
FIG. 13B is a schematic perspective view showing a main part of the print head in the third embodiment.

FIG. 13A is a schematic side view showing a use state of the print head in the third embodiment, and FIG. 13B is a schematic perspective view showing a main part of the print head in the third embodiment.

In FIGS. 13A and 13B, the print head 1*b* according to the third embodiment of the present invention differs from the print head according to the first embodiment in the fact that the print head 1*b* is an edge type in which the discharge generating portion 14 of the discharge electrode 5*a* is disposed on an inclined edge 3*b* of the substrate 3 on which the driver IC 6 is disposed.

The driver IC 6 and the IC cover 10 never interfere with the electrostatic latent image carrier and the recording medium even when the print head 1*b* is disposed so that the surface of the discharge electrode 5*a* becomes substantially parallel to the electrostatic latent image carrier and the recording medium as shown in FIG. 13A.

Since the print head according to the third embodiment is structured as above, the following effects are achieved in addition to the effects in the first embodiment.

(1) Since the driver IC 6 and the discharge electrode 5*a* are disposed so as to make an obtuse angle therebetween by disposing the discharge electrode 5*a* on the inclined edge 3*b* of the substrate 3 on which the driver IC 6 is disposed, especially a recording medium, such as digital paper, which should not be bent, can be conveyed rectilinearly, and hence the print head can be suitably used in a horizontal printer.

(2) Since the way according to which the electrode 5*a* is arranged is the edge type, the print head 1*b* can be disposed without being bulky in the height direction. Therefore, the print head 1*b* can correspond to electrostatic latent image carriers having various shapes, and excellent general versatility can be achieved.

Fourth Embodiment

A print head according to a fourth embodiment of the present invention will be hereinafter described with reference to the accompanying drawings.

Figure 14A:
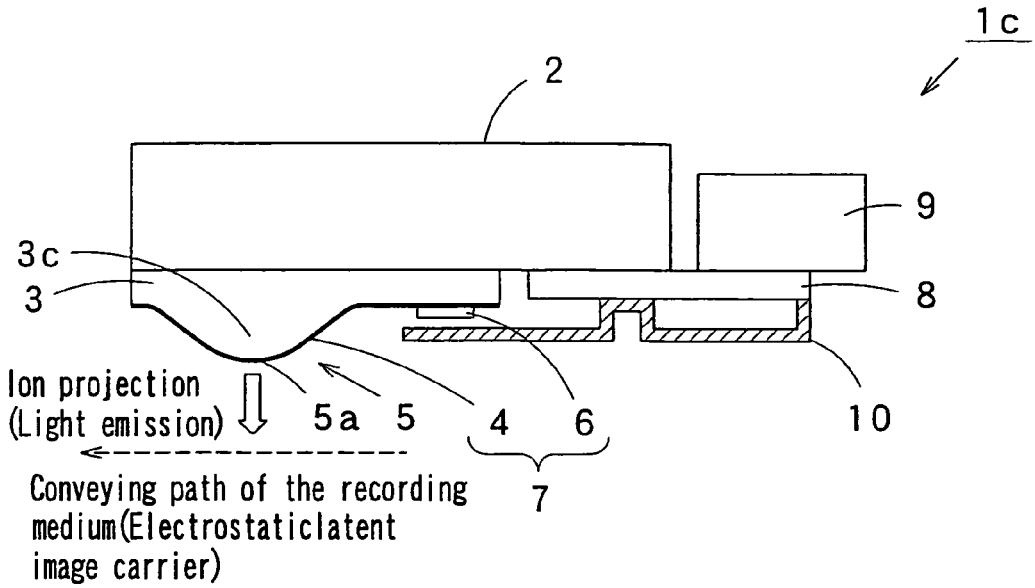
FIG. 14A is a schematic side view showing a use state of a print head in a fourth embodiment.
Figure 14B:
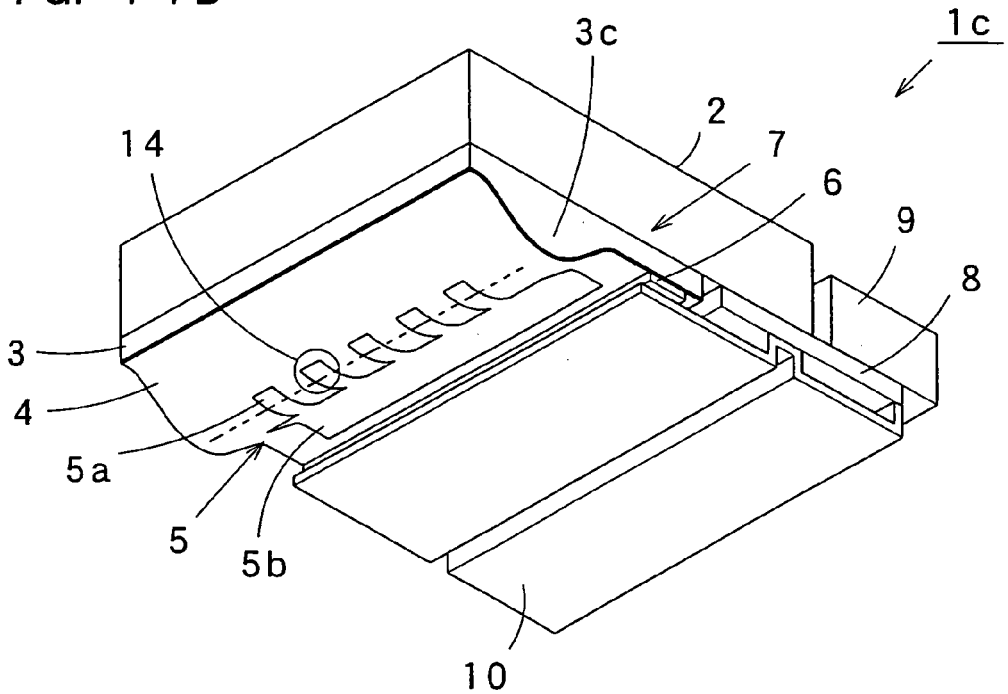
FIG. 14B is a schematic perspective view showing a main part of the print head in the fourth embodiment.

FIG. 14A is a schematic side view showing a use state of the print head in the fourth embodiment, and FIG. 14B is a schematic perspective view showing a main part of the print head in the fourth embodiment.

In FIGS. 14A and 14B, the print head 1*c* according to the fourth embodiment of the present invention differs from the print head according to the first embodiment in the fact that the print head 1*c* is a ridge type in which the discharge generating portion 14 of the discharge electrode 5*a* is disposed on a raised surface of a substantially barrel-roof-shaped ridge 3*c* jutting from the surface of the substrate 3 on which the driver IC 6 is disposed, in a state in which the raised surface extends more outwardly than the driver IC 6. The ridge type can be regarded as having a structure in which the end surface part 3*a* in the second embodiment is bent toward the surface of the substrate 3, and hence can be considered as a form of the end-surface type. In the field of the thermal print head, the ridge type is called a new end-surface type. As in the end-surface type and the edge type, the ridge type is characterized in that the surface on which the discharge electrode 5*a* is disposed and the surface on which the driver IC 6 is disposed are not flush with each other.

The ridge 3*c* is formed so as to jut from the driver IC 6 as described above. Therefore, when the discharge electrode 5*a* is disposed near the apex of the ridge 3*c*, the driver IC 6 and the IC cover 10 never interfere with the electrostatic latent image carrier and the recording medium even when the print head 1*c* is disposed so that the substrate 3 becomes substantially parallel to the electrostatic latent image carrier and the recording medium as shown in FIG. 14A.

If the discharge electrode 5*a* is disposed on a raised surface on the opposite side of the driver IC 6 of the ridge 3*c*, the height of the ridge 3*c* may become smaller than that of the driver IC 6. The reason is that interference with the driver IC 6 and other elements can be prevented by inclining the print head 1*c* so that the discharge electrode 5*a* becomes substantially parallel to the electrostatic latent image carrier and the recording medium.

Since the print head according to the fourth embodiment is structured as above, the following effects are achieved in addition to the effects in the first embodiment.

(1) Since the discharge electrode 5*a* is disposed on the apex of the ridge 3*c* of the substrate 3 on which the driver IC 6 is disposed in a state in which the apex of the ridge 3*c* extends more outwardly than the driver IC 6, the print head 1*c* can be disposed so that the substrate 3 becomes substantially parallel to the electrostatic latent image carrier and the recording medium. Especially, the recording medium, such as digital paper, which should not be bent, can be conveyed rectilinearly, and hence the print head can be suitably used in a horizontal printer.

(2) When the discharge electrode 5*a* is disposed on the raised surface on the opposite side of the driver IC 6 of the ridge 3*c*, the print head 1*c* is inclined so that the discharge electrode 5*a* becomes substantially parallel to the electrostatic latent image carrier and the recording medium. As a result, the electrostatic latent image carrier and the recording medium can be prevented from interfering with the driver IC 6 and other elements.

(3) Since the way according to which the discharge electrode 5*a* is arranged is the ridge type, the print head 1*c* can be disposed without being bulky in the height direction. Therefore, the print head 1*c* can correspond to electrostatic latent image carriers having various shapes, and excellent general versatility can be achieved.

Fifth Embodiment

An image forming apparatus according to a fifth embodiment of the present invention will be hereinafter described with reference to the accompanying drawings.

Figure 15:
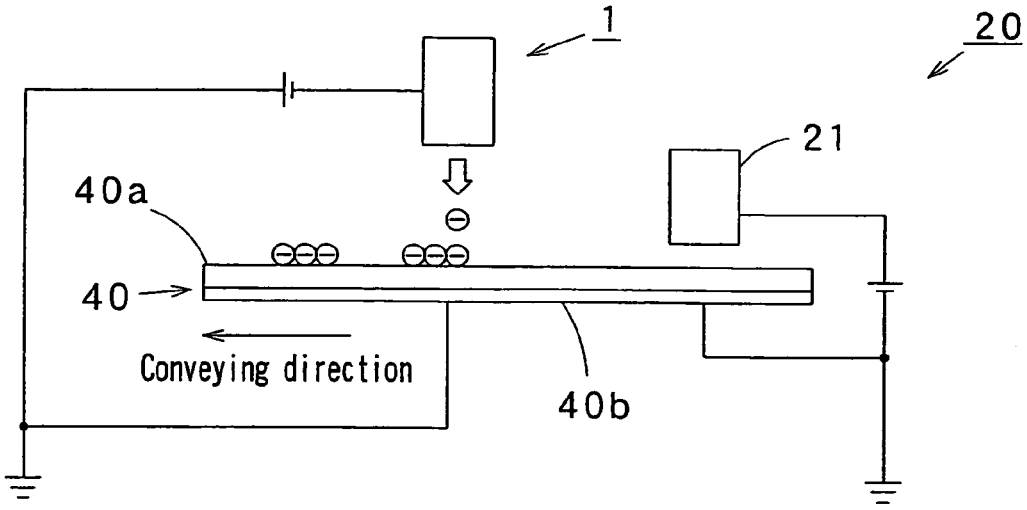
FIG. 15 is a schematic view showing a structure of a main part of an image forming apparatus in a fifth embodiment.

FIG. 15 is a schematic view showing a structure of a main part of the image forming apparatus according to the fifth embodiment.

In FIG. 15, reference character 20 denotes the image forming apparatus in the fifth embodiment that includes the print head 1, reference character 21 denotes a restoring device of the image forming apparatus 20 that initializes a recording medium 40 (i.e., that brings a recording medium 40 into a clean slate) by uniformly electrifying a medium board surface 40*a* of the recording medium 40, reference character 40 denotes the recording medium in which a visible image appears in its inside in reaction to an electric charge caused by an electric discharge of the print head 1, and reference character 40*b* denotes an earth electrode portion that is disposed on the reverse side of the recording medium 40 and that applies an electric field between the discharge electrode 5*a* of the print head 1 and the recording medium 40.

Preferably, an electrification roller or an electrification brush is used as the restoring device 21.

Instead of providing the restoring device 21, unnecessary records can be erased, and rewriting onto the recording medium 40 can be repeatedly performed by projecting ions, which have a polarity reverse to a polarity exhibited when an image is formed, from the print head 1.

Additionally, instead of the flat earth electrode portion 40*b*, an earth electrode roller may be provided.

The operation of the thus structured image forming apparatus will be described.

Before negative ions are projected from the print head 1, the recording medium 40 is beforehand initialized (i.e., brought into a clean slate) by electrifying the medium board surface 40*a* of the recording medium 40 so as to have a positive polarity reverse to that of the ions projected from the print head 1 by means of the restoring device 21.

Thereafter, negative ions are projected from the print head 1 to the medium board surface 40*a* of the recording medium 40, whereby a visible image appears inside the recording medium 40 in reaction to the negative electric charge. The visible image that has appeared inside the recording medium 40 is maintained unless a large potential difference is caused.

The thickness of the recording medium 40 is roughly 0.2 mm, and hence a serious hindrance will not be caused even if the recording medium 40 is bent without maintaining the flat state shown in FIG. 15 when printing is performed by use of the print head 1. However, in order not to reduce durability in repetitive use, it is preferable to perform a printing operation while keeping the recording medium 40 flat.

Although the print head 1 of the first embodiment is used in the image forming apparatus in this embodiment, any one of the print heads 1*a*, 1*b*, and 1*c* of the second to fourth embodiments may be used.

Since the image forming apparatus according to the fifth embodiment is structured as above, the following effects are achieved.

(1) Since the restoring device 21 by which the medium board surface 40*a* of the recording medium 40 is uniformly electrified is provided, the recording medium 40 in which a visible image appears in its inside in reaction to an electric charge caused by an electric discharge can be initialized (i.e., brought into a clean slate). Therefore, unnecessary records can be erased, and rewriting onto the recording medium 40 can be repeatedly performed.

(2) Since the print head 1 is provided, an image can be formed inside the recording medium 40 in a noncontact manner merely by projecting ions onto the medium board surface 40*a* of the recording medium 40. Therefore, with a smaller number of components, damage to the recording medium 40 can be restricted to the minimum necessary, and hence excellent practicality can be achieved.

Sixth Embodiment

An image forming apparatus according to a sixth embodiment of the present invention will be hereinafter described with reference to the accompanying drawings.

Figure 16:
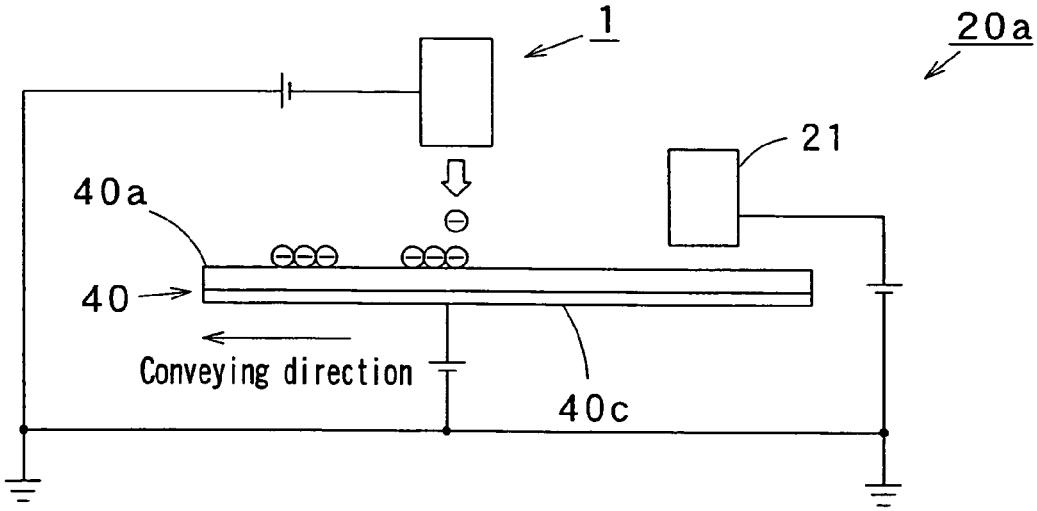
FIG. 16 is a schematic view showing a structure of a main part of an image forming apparatus in a sixth embodiment.

FIG. 16 is a schematic view showing a structure of a main part of the image forming apparatus in the sixth embodiment.

In FIG. 16, the image forming apparatus 20*a* according to the sixth embodiment of the present invention differs from the image forming apparatus 20 according to the fifth embodiment in the fact that a positive-voltage application portion 40*c*, instead of the earth electrode portion 40*b*, is disposed on the reverse side of the recording medium 40 and in the fact that a positive voltage is applied.

Negative ions generated by an electric discharge can be attracted to the medium board surface 40*a* of the recording medium 40 by applying a positive voltage to the positive-voltage application portion 40*c* disposed on the reverse side of the recording medium 40. Since negative ions can be reliably projected onto the recording medium 40, image quality can be improved.

Although the print head 1 of the first embodiment is used in the image forming apparatus in this embodiment, any one of the print heads 1*a*, 1*b*, and 1*c* of the second to fourth embodiments may be used.

Since the image forming apparatus according to the sixth embodiment is structured as above, the following effect is achieved in addition to the effects achieved in the fifth embodiment.

(1) Since the positive-voltage application portion 40*c* is disposed on the reverse side of the recording medium 40, negative ions generated by an electric discharge resulting from the application of a positive voltage can be attracted to the medium board surface 40*a* of the recording medium 40. Therefore, negative ions can be reliably projected onto the recording medium 40, and hence image quality can be improved.

Seventh Embodiment

An image forming apparatus according to a seventh embodiment of the present invention will be hereinafter described with reference to the accompanying drawings.

Figure 17:
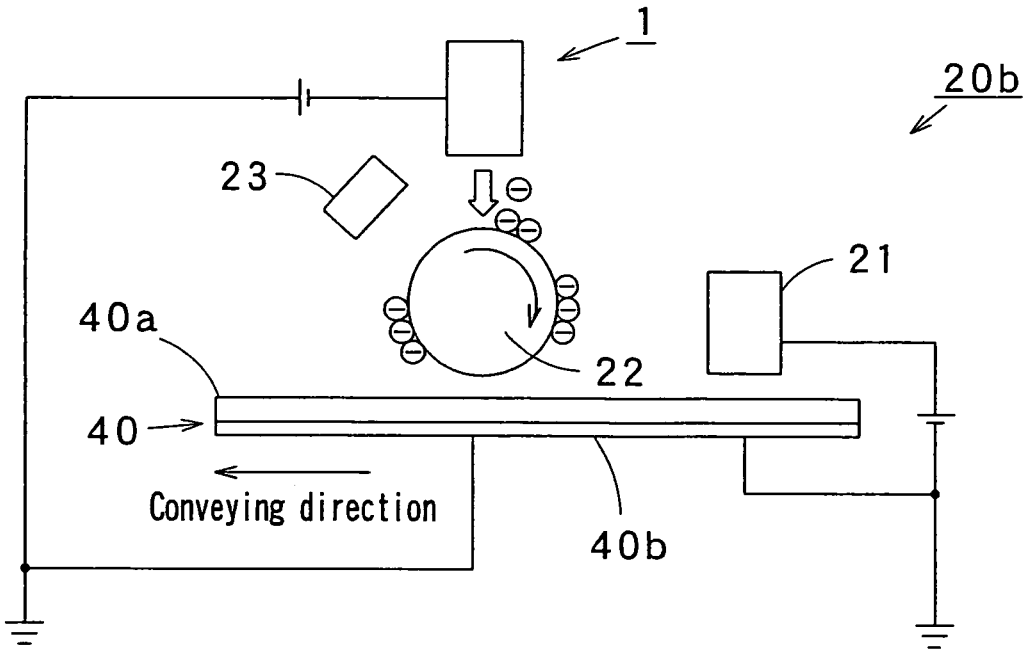
FIG. 17 is a schematic view showing a structure of a main part of an image forming apparatus in a seventh embodiment.

FIG. 17 is a schematic view showing a structure of a main part of the image forming apparatus in the seventh embodiment.

In FIG. 17, the image forming apparatus 20*b* according to the seventh embodiment of the present invention differs from the image forming apparatus 20 according to the fifth embodiment in the fact that the image forming apparatus 20*b* includes an electrostatic latent image carrier 22 on the surface of which an electrostatic latent image is formed by ions projected from the print head 1 and a static eraser 23 that destaticizes the surface of the electrostatic latent image carrier 22 before performing a writing operation (i.e., ion projection) by the print head 1.

Any of carriers having various shapes, such as a drum-shaped carrier or a belt-shaped carrier, can be used as the electrostatic latent image carrier 22. What is required of the electrostatic latent image carrier 22 is to have a surface capable of being electrified by ion projection. Therefore, the electrostatic latent image carrier 22 is not limited to a photoconductor, and hence an insulator, such as alumite, can be used as a material of the electrostatic latent image carrier 22. Such an insulator has stronger resistance to deterioration than the photoconductor, and excellent longevity can be achieved.

Additionally, since the static eraser 23 is provided, an electrostatic latent image can be formed on the surface of the electrostatic latent image carrier 22 in a stable state at any time, and excellent reliability can be achieved. If the electrostatic latent image carrier 22 is a photoconductor, the surface thereof can be destaticized by projecting a beam of light, and, if the electrostatic latent image carrier 22 is an insulator, the surface thereof can be destaticized by an AC voltage.

The operation of the thus structured image forming apparatus according to the seventh embodiment of the present invention differs from the operation thereof according to the fifth embodiment in the fact that an electrostatic latent image is first formed on the electrostatic latent image carrier 22, and then the recording medium 40 is subjected to electrostatic development by use of the electrostatic latent image so as to form a visible image without projecting ions directly onto the medium board surface 40*a* of the recording medium 40 from the print head 1. Since the print head 1 does not directly face the recording medium 40, the print head 1 can be prevented from being stained.

As in the sixth embodiment, a positive-voltage application portion 40*c*, instead of the earth electrode portion 40*b*, may be disposed on the reverse side of the recording medium 40, and a positive voltage may be applied.

Although the print head 1 of the first embodiment is used in the image forming apparatus in this embodiment, any one of the print heads 1*a*, 1*b*, and 1*c* of the second to fourth embodiments may be used.

Since the image forming apparatus according to the seventh embodiment is structured as above, the following effects are achieved in addition to the effects achieved in the fifth embodiment.

(1) An electrostatic latent image can be formed on the surface of the electrostatic latent image carrier 22 by projecting ions from the print head 1, and a visible image can be formed by subjecting the recording medium 40 to electrostatic development by use of the electrostatic latent image. Therefore, the print head 1 does not directly face the recording medium 40, and can be prevented from being stained.

(2) Since the electrostatic latent image carrier 22 that has no need of uniform electrification is used, an electrostatic latent image can be formed only through the single step of ion projection, and hence an image forming process can be simplified.

Eighth Embodiment

An image forming apparatus according to an eighth embodiment of the present invention will be hereinafter described with reference to the accompanying drawings.

Figure 18:
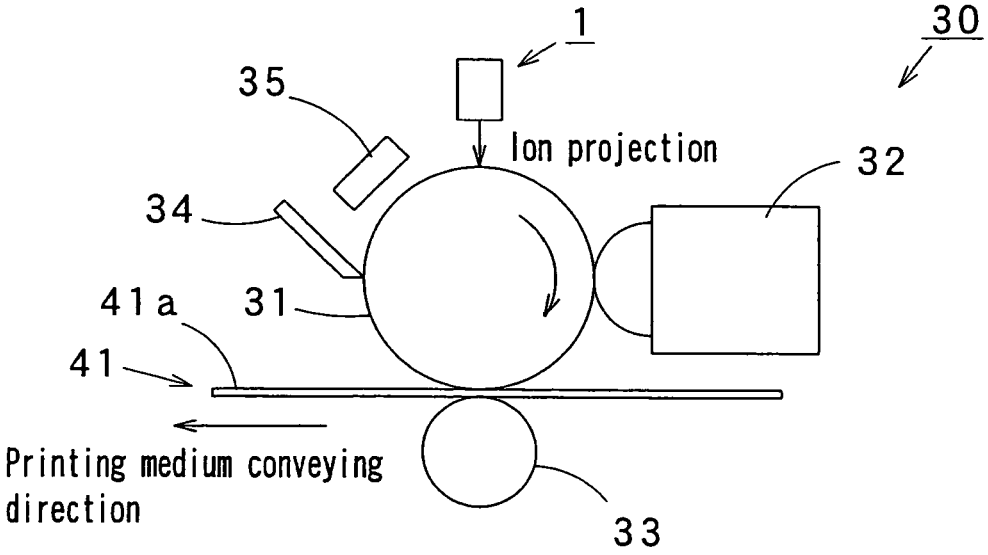
FIG. 18 is a schematic view showing a structure of a main part of an image forming apparatus in an eighth embodiment.

FIG. 18 is a schematic view showing a structure of a main part of the image forming apparatus in the eighth embodiment.

In FIG. 18, reference character 30 denotes the image forming apparatus in the eight embodiment that includes the print head 1, reference character 31 denotes an electrostatic latent image carrier on the surface of which an electrostatic latent image is formed by projecting ions from the print head 1, reference character 32 denotes a developing device serving as a visualizing means that forms a visible image on the surface of the electrostatic latent image carrier 31 based on the electrostatic latent image, reference character 33 denotes a transfer fixing roller serving as a transferring means that transfers the visible image onto a surface 41*a* of a printing medium 41, reference character 34 denotes a cleaner that physically scrapes off a toner remaining on the surface of the electrostatic latent image carrier 31 after the transfer operation so as to clean the surface thereof, reference character 35 denotes a static eraser that destaticizes the surface of the electrostatic latent image carrier 31 prior to a writing operation (ion projection) performed by the print head 1, and reference character 41 denotes the printing medium such as regular paper, an OHP sheet, or glossy paper.

In this embodiment, although the developing device 32 that performs toner development is used as the visualizing means, the development may be performed with ink or according to another method. The transfer fixing roller 33 used in this embodiment has a roller surface made of a metal, such as aluminum, that is covered with synthetic rubber, such as silicone rubber. When the toner development is performed, a pressure-fixed type toner is used. This toner is pressed by the transfer fixing roller 33, whereby a visible image is transferred and fixed to the surface 41*a* of the printing medium 41.

Additionally, since the cleaner 34 and the static eraser 35 are provided, an electrostatic latent image can be formed on the surface of the electrostatic latent image carrier 31 in a stable state at any time, and excellent reliability can be achieved.

The same carrier as the electrostatic latent image carrier 22 used in the seventh embodiment can be used as the electrostatic latent image carrier 31.

The operation of the thus structured image forming apparatus will be described.

When negative ions are projected from the print head 1, the surface of the electrostatic latent image carrier 31 is destaticized by the static eraser 35. The destaticizing operation is performed by, for example, a corona discharge. A negative electrostatic latent image is formed on the surface of the electrostatic latent image carrier 31 by projecting negative ions from the print head 1 onto the electrostatic latent image carrier 31 that has been electrically cleaned and from which an afterimage of the electrostatic latent image has disappeared. The electrostatic latent image is then developed by the developing device 32, and becomes visible. The visible image is pressed by the transfer fixing roller 33, and is transferred and fixed to the surface 41*a* of the printing medium 41.

Although the print head 1 of the first embodiment is used in the image forming apparatus in this embodiment, any one of the print heads 1*a*, 1*b*, and 1*c* of the second to fourth embodiments may be used.

Since the image forming apparatus according to the eighth embodiment is structured as above, the following effects are achieved.

(1) Since the image forming apparatus includes the electrostatic latent image carrier 31 on the surface of which an electrostatic latent image is formed by ion projection from the print head 1, an exposure optical system, such as a polygon mirror, is not required, and hence the structure can be simplified with a smaller number of components.

(2) A visible image can be formed on the surface of the electrostatic latent image carrier 31 based on an electrostatic latent image by use of the developing device 32 serving as a visualizing means, and the visible image can be transferred to the surface 41*a* of the printing medium 41 by the transferring means. Therefore, various mediums, such as OHP sheets and glossy paper in addition to regular paper, can be used as the printing medium 41, and excellent general versatility can be achieved.

(3) If an insulator, such as alumite, is used for the electrostatic latent image carrier 31, damage will not be easily caused by the scraping operation of the cleaner 34, and excellent longevity can be achieved.

The present invention can provide a print head that is usable in a horizontal printer, that is small in size, that is superior in mass production, that can easily perform discharge control, that is excellent in reliability, and that is excellent in practicality to be writable in a state in which a recording medium is not bent, and can provide an image forming apparatus including the print head that is superior in the arrangement flexibility of the print head with respect to an electrostatic latent image carrier, that is superior in the general versatility of being capable of forming an electrostatic latent image from an optimum position on the electrostatic latent image carrier that can be variously shaped, and that is superior in the reliability of image quality.

What is claimed is:

1. A print head comprising a discharge-by-heating type discharge control unit, said discharge control unit including:

a heating means including a substrate, a heat generation portion provided with a heat generation body formed on said substrate, and a driver IC that controls heat generation of said heat generation body; and a discharge portion including a discharge electrode disposed in accordance with said heat generation body;

wherein said heat generation portion and said discharge portion are insulated from each other, wherein said discharge electrode is provided with a discharge generating portion where an electric discharge is caused by being heated by said heat generation body; and wherein a surface on which said discharge generating portion of said discharge electrode is disposed and a surface on which said driver IC is disposed are not flush with each other.

2. The print head of claim 1, wherein a way according to which said discharge generating ion of said discharge electrode is arranged is an end-surface type in which said discharge generating portion of said discharge electrode is disposed at an end surface part of said substrate.

3. The print head of claim 1, wherein a way according to which said discharge generating portion of said discharge electrode is arranged is an edge type in which said discharge generating portion of said discharge electrode is disposed on an edge of said substrate, so as to make an obtuse angle with a surface of said substrate.

4. The print head of claim 1, wherein a way according to which discharge generating portion of said discharge electrode is arranged is a ridge type in which said discharge generating portion of said discharge electrode is disposed on a raised surface of a ridge formed on a surface of said substrate.

5. The print head of claim 1, further comprising a high-pressure board that is electrically connected to said discharge portion and that supplies a discharge control voltage to said discharge electrode.

6. The print head of claim 1, wherein a head substrate having said heat generation portion and said discharge portion which are formed on said substrate is disposed on a heat radiating plate.

7. An image forming apparatus comprising: a print head including:

a discharge-by-heating type discharge control unit, said discharge control unit including:

a heating means including a substrate, a heat generation portion provided with a heat generation body formed on said substrate and a driver IC that controls heat generation of said heat generation body; and a discharge portion including a discharge electrode disposed in accordance with said heat generation body;

wherein said heat generation portion and said discharge portion are insulated from each other, wherein said discharge electrode is provided with a discharge generating portion where an electric discharge is caused by being heated by said heat generation body, and wherein a surface on which said discharge generating portion of said discharge electrode is disposed and a surface on which said driver IC is disposed are not flush with each other.

8. The image forming apparatus of claim 7, wherein recording is performed onto a recording medium in which a visible image appears in an inside of said recording medium in reaction to an electric charge generated by an electric discharge of said print head.

9. The image forming apparatus of claim 7, further including an electrostatic latent image carrier that faces said print head.

10. The image forming apparatus of claim 9, further including:

said electrostatic latent image carrier;

a visualizing means for forming a visible image on a surface of said electrostatic latent image carrier based on an electrostatic latent image formed on a surface of said electrostatic latent image carrier; and a transferring means for transferring said visible image to a printing medium.

* * * * *